US007907043B2

(12) United States Patent
Mori

(10) Patent No.: US 7,907,043 B2
(45) Date of Patent: Mar. 15, 2011

(54) PLANAR INDUCTOR

(76) Inventor: Ryutaro Mori, Saitama (JP)

( * ) Notice: Subject to any disclaimer, the term of this patent is extended or adjusted under 35 U.S.C. 154(b) by 0 days.

(21) Appl. No.: 12/085,577

(22) PCT Filed: Nov. 29, 2006

(86) PCT No.: PCT/JP2006/323788

§ 371 (c)(1),
(2), (4) Date: Feb. 10, 2009

(87) PCT Pub. No.: WO2007/063884

PCT Pub. Date: Jun. 7, 2007

(65) Prior Publication Data

US 2010/0141369 A1 Jun. 10, 2010

(30) Foreign Application Priority Data

Nov. 30, 2005 (JP) ..... 2005-346039

(51) Int. Cl.
*H01F 5/00* (2006.01)

(52) U.S. Cl. ..... 336/200; 336/223; 336/232

(58) Field of Classification Search ..... None
See application file for complete search history.

(56) References Cited

U.S. PATENT DOCUMENTS

| | | | | |
|---|---|---|---|---|
| 6,236,297 | B1 * | 5/2001 | Chou et al. | 336/200 |
| 2006/0214760 | A1 * | 9/2006 | Menegoli et al. | 336/223 |
| 2007/0075819 | A1 * | 4/2007 | Okuzawa et al. | 336/200 |
| 2007/0296369 | A1 * | 12/2007 | Yeh | 318/696 |

FOREIGN PATENT DOCUMENTS

JP 11-095922 A 4/1999

* cited by examiner

*Primary Examiner* — Anh T Mai
(74) *Attorney, Agent, or Firm* — Edwards Angell Palmer & Dodge LLP

(57) ABSTRACT

To provide a planar inductor that can be easily designed in any size without restricting coil characteristics, that supplies the necessary power corresponding to the area when a pair of inductors are placed facing each other to carry out non-contact power transmission, and that has greater design flexibility that allows for setting separation cut-off lines with relative freedom.

A planar inductor comprising a flat coil support layer that supports multiple flat coils arrayed in a plane and a first interconnection layer provided on one side of said flat coil support layer and a second interconnection layer provided on the other side of the flat coil support layer, wherein each flat coils start point is connected through the first interconnection layer and each flat coils end point is connected through the second interconnection layer, and a parallel electrical connection of the multiple flat coils arrayed in a plane is thereby achieved between the first interconnection layer and the second interconnection layer.

16 Claims, 24 Drawing Sheets

(a) Coil Layout on the First Planar Inductor (b) Coil Layout on the Second Planar Inductor (a) Ring Conductor Shape (b) A Layout of Ring Conductors (a) Air Core (c) Vacuum Core (b1) Vertical Cross-sectional View of Pipe Core Mounted on Grid Base (b2) Planar View of Pipe Core Mounted on Grid Base (a) Definition of Coil Diameter (b) Coil Diameter, Coil Interval, and Distance between Axis Centers (a) Planar View (b) Equivalent Circuit (a) First Pattern (b) Second Pattern (c) Third Pattern (a) A Layout of Ring Conductors (b) A Layout of Equilateral Rectangular Ring Conductors (a) Perfectly Aligned (N)
N
(S)
S
(N)
N
(S)
S
(N)
N
(S)
S (a) Uppermost Layer (b) Layer One Layer Below the Uppermost Layer (c) Lowermost Layer (b) Layer One Layer Below the Uppermost Layer (a) Uppermost Layer (b) Layer One Layer Below the Uppermost Layer (a) Uppermost Layer (b) Equilateral Hexagon Layout (a) Parallelogram Layout

PLANAR INDUCTOR

TECHNICAL FIELD

The present invention relates, for example, to a planar inductor which is optimum for a non-contact power transmission system, or the like, and in particular to a planar inductor with a flat coil carry layer which carries flat coils arrayed in a plane.

BACKGROUND OF THE INVENTION

Planar inductors with a flat coil carry layer which carries dispersed flat coils in a plane are well known (for example, see Patent Document 1).

The planar inductor is configured as a mouse pad. Built into the mouse pad is a power transmission system which transmits, without contact, power supplied from a plug to a cordless mouse. The power transmission system consists of a frequency conversion circuit which converts the power at commercial frequency supplied from the plug into the power at a desired frequency, and multiple planar spiral coils which are provided within the mouse pad. The planar spiral coils are laid on the upper surface of a soft magnetic ferrite plate and connected so that the mutually adjacent planar spiral coils each face in the opposite direction to correspond to the direction of the flux at a given time.

Patent Document 1: Unexamined Patent Publication (Kokai) No. H11-95922

DISCLOSURE OF THE INVENTION

Problems to be Solved by the Invention

However, due to the fact that the multiple planar spiral coils (flat coils) built into the mouse pad (planar inductor) described in the foregoing Patent Document 1 are serially connected between the output terminals of the frequency conversion circuits which functions as a radio-frequency (RF) power supply, the power transmission efficiency decreases because, in order to, for example, expand the power transmittable area (the mouse s movable region), the voltage applied to each coil decreases in inverse proportion to the increased number of coils when attempting to expand the mouse pad region. In order to resolve this, there are problems in that the number of turns and the wire diameter of the individual coils must be increased, and for these reasons the degree of design flexibility is inferior.

In addition, if anticipating an application of use for said serial-type planar inductors wherein they are prepared in advance with a fixed area for mass production and are cut to the required size along with predetermined separation lines, there are problems in that the conductor pattern between the coils becomes complex because all the circuits must be fully separated into multiple serial circuits demarcated by separation cut-off lines, and for these reasons the degree of design flexibility is inferior.

When the invention was created, attention was given to the above-mentioned problems, and the purpose of the invention is to provide a planar inductor with greater design flexibility which allows for the easy design of a planar inductor in any size, wherein the coil characteristics, such as the number of coil turns or the coil wire diameter, are not restricted, which allows the necessary power corresponding to the area when a pair of devices with the same area are placed facing each other to carry out non-contact power transmission, and, furthermore, which allows the relatively free setting of separation cut-off lines.

Another purpose of the present invention is to provide a planar inductor optimum for not only a non-contact power transmission system, but also for being incorporated into printed-circuit boards or semiconductor devices (LSIs), or, furthermore, planar antennas or the like.

More purposes, and advantages and effects, of the invention should easily be understood by those skilled in the art in reference to the specifications described below.

Means for Solving the Problem

The planar inductor of the present invention comprises a plurality of flat coils, a flat coil carry layer carrying said flat coils arrayed in a plane, a first interconnection layer provided on one side of the flat coil carry layer, and a second interconnection layer provided on the other side of the flat coil carry layer, wherein start points of the flat coils are connected through the first interconnection layer and end points of the flat coils are connected through the second interconnection layer, thereby achieving a parallel electrical connection of the flat coils arrayed in the plane between the first and second interconnection layer.

In this invention, the flat coils are arranged so that their axes (magnetic cores) are perpendicular to the plane formed by the flat coil carry layer, or in other words, so that the plane which contains the flat coils and the plane formed by the flat coil carry layer are parallel, and supported by the flat coil carry layer, wherein said flat coils could be either in the shape of a circular ring or a polygonal ring, and wherein the number of turns could be one turn or two or more turns. In addition, the magnetic core could either have no core or have a core (that is, an iron core). In addition, the said flat coils can be formed in a variety of configurations as needed, such as turned wires, formed in a multi-layer or single-layer circuit board by using an etching process, or formed on a silicon substrate by using semiconductor fabrication technologies, according to their applications.

Accordingly, if adopting a configuration that places a plurality of flat coils mutually connected in parallel between the first and the second interconnection layer, the voltage applied to each coil would not change even if the number of coils were increased or decreased because, if deriving, for example, feeding terminals extended from the first and the second interconnection layers which are connected with an AC or RF power supply, the supply voltage can be applied as-is to each flat coil. Therefore, the number of coils can be increased or decreased without restricting the coil characteristics, such as the number of coil turns or the coil diameter, a planar inductor with a given area can easily be designed, the required power to be transmitted can be adjusted by maintaining a coil density per a given area and by increasing or decreasing the area itself when positioning a pair of planar inductors facing each other to carry out non-contact power transmission, and, furthermore, separation cut-off lines can be set with relative freedom since each coil is individually supplied power from a power supply.

The preferred embodiment of the foregoing planar inductor of the present invention is a planar inductor wherein multiple flat coils are arrayed so that the turning direction of the adjacent flat coils is different. With such a configuration, there is the advantage that the magnetic flux flowing from each coil's magnetic pole will quickly flow into the adjacent coils magnetic pole because the magnetic pole polarities of a pair of adjacent coils are all opposite to form a grid or lattice-shaped magnetic flux distribution in an orderly fashion, and because, as a result, it will be difficult for the flux to leak outside because the push-pull operation is performed as a magnetic circuit.

Then, if both the first and the second interconnection layers are non-magnetic solid conductor layers (e.g., a solid pattern of a typical non-magnetic metal such as Au, Ag, or Cu), each of which covers all the column-wise and row-wise arrayed flat coils, the first and second interconnection layers themselves function as an electromagnetic shield layer, thereby ensuring the prevention of the flux from leaking outside.

In addition, if a flux-passing hole is opened on the first interconnection layer positioned on the surface corresponding to the position of the magnetic pole (magnetic core position) of each flat coil, the flux flowing from each magnetic pole is emitted outside only through the flux-passing hole to allow efficient non-contact power transmission when lattice-shaped flux distribution is formed to couple the flux-passing holes and suppress flux leaks at all times and another planar inductor with the same coil layout pattern is placed in a facing position.

Furthermore, if a second interconnection layer is formed as a line pattern that couples the flat coil end points in the planar view and an antenna pattern with given tuning characteristics is included in this line pattern, it allows for the production of a planar antenna with the above features or a transformer with tuning characteristics.

From another perspective, the invention can be considered as a planar transformer which is optimum for a non-contact power transmission system or the like. Said planar transformer includes the first planar inductor and the second planar inductor.

Said planar inductors each have, in the same manner, a plurality of flat coils, a flat coil carry layer that carries said flat coils arrayed in a plane, a first interconnection layer provided on one side of the flat coil carry layer, and a second interconnection layer provided on the other side of the flat coil carry layer.

Each flat coil start point is connected through the first interconnection layer and each flat coil end point is connected through the second interconnection layer, and the flat coils are, whether in a column-wise or row-wise position, arrayed so that the turning direction of each one is different.

The first interconnection layer and the second interconnection layer are each a nonmagnetic solid conductor layer that covers all the arrayed flat coils, and a flux-passing hole is opened on the first interconnection layer positioned on the surface corresponding to the position of the magnetic pole of each flat coil, and, furthermore, a first insulator film layer and second insulator film layer covers each outside surface of the first and second interconnection layer.

This configuration with the first and second planar inductors facing each other allows power transmission by using magnetic coupling between these two planar inductors.

Such a planar transformer allows for efficient power transmission via electromagnetic coupling among facing coil pairs between a paired power transmitter object and power receptor object (such as a mouse pad and a mouse, or a charger holder and a cell phone) if the first and second inductors comprising the planar transformer are separated and fixed (e,g, adhered) to the power transmitter object and the power receptor object, respectively.

In particular, said planar transformer allows for the required power to be easily secured by simply increasing or decreasing the facing areas of the first planar inductor and the second planar inductor because the total power amount transmitted between the power transmitter object and power receptor object is the sum of the power transmitted between each pair of facing flat coils.

In addition, power can be fed to individual flat coils via the first and second interconnection layers positioned on both sides of the flat coil support layer, so that if a specific planar area is separated from the entire surface, power can be fed to the remaining surface area. Therefore, if planar inductors with a fixed size are manufactured, any specific power need can be satisfied by just cutting them into a required size.

Effect of the Invention

With the planar inductor of the present invention, the voltage applied to each coil would not change even if the number of coils is increased or decreased because, if deriving, e.g., feeding terminals, which are extended from the first and the second interconnection layers, are connected with an AC or RF power supply, the supply voltage can be applied as-is to each flat coil. Therefore, the number of coils can be increased or decreased without restricting the coil characteristics, such as the number of coil turns or the coil diameter, a planar inductor with a given area can easily be designed, the required power to be transmitted can be adjusted by maintaining a coil density per a given area and by increasing or decreasing the area itself when positioning a pair of planar inductors facing each other to carry out non-contact power transmission, and, furthermore, separation cut-off lines can be set with relative freedom since each coil is individually supplied power from the power supply.

DESCRIPTION OF THE PREFERRED EMBODIMENTS

The following details a preferred embodiment of the planar inductor of the present invention based on the attached drawings.

FIG. 1 roughly illustrates an example of use, as an exploded perspective view, of the non-contact power transmission planar transformer manufactured by using the planar inductor of the present invention.

As shown in FIG. 1, said planar transformer includes a first planar inductor 3 which is mounted within a given power transmitter object (for example, a charger hole for a cell phone, a mouse pad, etc.) 2, and a second planar inductor 5 which is mounted within a given power receptor object (for example, cell phone, mouse, etc.) 4. In this example, the shape appearance of the first and second planar inductors 3 and 5, respectively, are formed into a rigid or flexible substrate with a width of approximately 0.3 mm-3.0 mm, and the internal structures of both are formed almost the same, as described below.

Next, when power transmitter object 2 and power receptor object 4 are placed close together, and the first planar inductor 3 and the second planar inductor 5 are facing each other, non-contact power transmission takes place between the first planar inductor 3 and the second planar inductor 5 through electromagnetic coupling.

FIG. 2 illustrates, in a rough vertical cross-sectional view, the first and the second planar inductors 3 and 5 positioned facing each other. In this example, the first and second planar inductors 3 and 5 are manufactured by using the technologies for manufacturing printed-wiring boards using materials such as ceramic or plastic, including polyimide and epoxy.

As shown in FIG. 2, said planar inductors 3 and 5 have flat coil carry layers 3*a* and 5*a* with a width of approximately 0.2 mm-2.8 mm, first interconnection layers 3*b* and 5*b* with a width of approximately 0.05 mm-1.0 mm provided on the front surface (on one side) of flat coil carry layers 3*a* and 5*a*, and second interconnection layers 3*c* and 5*c* with a width of approximately 0.05 mm-10.0 mm provided on the rear surface (the other side) of flat coil carry layers 3*a* and 5*a*.

In this example, flat coil carry layers 3*a* and 5*a* are composed of a single- or multi-layer flexible wiring board made of plastic, such as polyimide, epoxy, or ceramic, or the like. On this board, laminating technology or etching technology already known to public is applied to faun a single- or multi-layer ring conductor pattern corresponding to each turn of flat coil.

Note that in FIG. 2 Reference Numerals T11 and T22 indicate the primary terminals for applying AC or RF power between the first interconnection layer 3*b* and the second interconnection layer 3*c* of first planar inductor 3, and Reference Numerals T21 and T22 indicate the secondary terminals for extracting received power output from between the first interconnection layer 5*b* and the second interconnection layer 5*c* of the second planar inductor. A frequency ranging from 30 Hz to 2 MHz is used as an AC or RF power supply in this example.

FIG. 3 illustrates a layout of dispersed flat coils in a planar view.

As shown in FIG. 3(*a*), multiple flat coils 6 (clockwise coil 6*a* and counterclockwise coil 6*b*) dispersed in matrix in a plane are carried by flat coil carry layer 3*a* of the first planar inductor 3. In this example, the diameter Φ of said flat coils can be selected in a range from 0.15 mm to 50 mm depending on their applications.

In other words, assuming that when viewed from the surface of first planar inductor 3, the coils among flat coils 6 wound in the clockwise direction are defined as clockwise coils 6*a*, the coils among flat coils 6 wound in the counterclockwise direction are defined as counterclockwise coils 6*b*, the mutually parallel lines which extend in column-wise direction are defined as column-wise lines 7*m*, 7*m*+1, 7*m*+2, 7*m*+3, the mutually parallel lines which extend in row-wise direction are defined as row-wise lines 8*n*, 8*n*+1, 8*n*+2, 8*n*+3 . . . , and the spaces between the column-wise lines and those between the row-wise lines are all equal to L1, said flat coils 6 are all arranged on the intersecting points of column-wise lines 7*m*, 7*m*+1, 7*m*+2, 7*m*+3 as well as row-wise lines 8*n*, 8*n*+1, 8*n*+2, 8*n*+2, 8*n*+3 . . . in order.

It is important to note that clockwise coil 6*a* and counterclockwise coil 6*b* alternately appear on the coil strings on all column-wise lines 7*m*, 7*m*+1, 7*m*+2, 7*m*+3, and clockwise coil 6*a* and counterclockwise coil 6*b* alternately appear on the coil strings on all row-wise lines 8*n*, 8*n*+1, 8*n*+2, 8*n*+3.

As a result, for any of the clockwise coils 6*a*, the four column-wise or row-wise adjacent flat coils are counterclockwise coils (reverse coils) 6*b*, and similarly for any of the counterclockwise coils 6*b*, the four column-wise or row-wise adjacent flat coils are counterclockwise coils (reverse coils) 6*a*. As explained below, this condition will cause a grid-like flux distribution.

Similarly, as shown in FIG. 3(*b*), multiple flat coils 9 (9*a*, 9*b*) dispersed in matrix in a plane are carried by flat coil carry layer 5*a* of the second planar inductor 5.

In other words, assuming that when viewed from the surface of first planar inductor 5, the coils among flat coils 6 wound in the clockwise direction are defined as clockwise coils 9*a*, the coils among flat coils 6 wound in the counterclockwise direction are defined as counterclockwise coils 9*b*, the mutually parallel lines which extend in column-wise direction are defined as column-wise lines 10*k*, 10*k*+1, 10*k*+2, 10*k*+3, the mutually parallel lines which extend in row-wise direction are defined as row-wise lines 11*l*, 11*l*+1, 11*l*+2, 11*l*+3, and the spaces between the column-wise lines and those between the row-wise lines are all equal to L1, said flat coils 6 are all arranged on the intersecting points of column-wise lines 10*k*, 10*k*+1, 10*k*+2, 10*k*+3 as well as row-wise lines 11*l*, 11*l*+1, 11*l*+2, 11*l*+3 in order.

It is important to note that clockwise coil 9*a* and counterclockwise coil 9*b* alternately appear on the coil strings on any of the column-wise lines 10*k*, 10*k*+1, 10*k*+2, 10*k*+3, and clockwise coil 9*a* and counterclockwise coil 9*b* alternately appear on the coil strings on any of the row-wise lines 11*l*, 11*l*+1, 11*l*+2, 11*l*+3

As a result, for any of clockwise coils 9*a*, the four column-wise or row-wise adjacent flat coils are counterclockwise coils (reverse coils) 9*b*, and similarly for any of the counterclockwise coils 9*b*, the four column-wise or row-wise adjacent flat coils are counterclockwise coils (reverse coils) 9*a*.

FIG. 4 illustrates an equivalent circuit which indicates connections between the flat coils and the interconnection layers when the first planar inductor 3 and the second planar inductor 5 are facing each other.

As shown in FIG. 4, for the first planar inductor 3, the start point of each flat coil 6 (clockwise coil 6*a* and counterclockwise coil 6*b*) is connected through the first interconnection layer 3*b*, and the end point of each flat coil 6 is connected through the second interconnection layer 3*c*, thereby achieving the parallel electrical connection of the multiple flat coils 6 arranged in matrix in a plane. Note that both items 3*d* and 3*e* are plastic insulator films.

Similarly, for the second planar inductor 5, the start point of each flat coil 9 (clockwise coil 9*a* and counterclockwise coil 9*b*) is connected through the first interconnection layer 5*b*, and the end point of each flat coil 9 is connected through the second interconnection layer 5*c*, thereby achieving the parallel electrical connection of the multiple flat coils 9 arranged in matrix in a plane. Note that both items 5*d* and 5*e* are plastic insulator films.

Flat coils manufactured by using single or multi-layer printed wiring board technologies can be in a variety of structures. Examples of such flat coils include single-layer/single-turn coils, which have a single layer and a single turn (1 turn), single layer/multi-turn coils with a single layer and at least two turns (2 turns), multi-layer/single turn coils, which have multiple layers and each layer has a single turn (1 turn), multi-layer/multi-turn coils, which have multiple layers and each layer has at least two turns (2 turns), and so on.

The number of layers, the number of turns per layer, the coil diameter, or the like, can be determined appropriately in consideration of various factors, such as the required power to be transmitted, the facing area to be used for power transmission, and the range within which the power transmitter object and power receptor object move.

FIG. 5, a vertical cross-sectional view, and FIG. 6(*a*), a planar view, illustrates a specific example of the structure of a multi-layer/single turn coil which functions as a flat coil.

In FIG. 5, Reference Numeral 12 denotes a flexible multi-layer wiring board manufactured by using plastic, such as polyimide, epoxy, or the like, or ceramics, or the like, as the materials. In this example, said multi-layer wiring board consists of seven layers of board from first layer board 12-1 to seventh layer board 12-7, wherein first insulator film layer (plastic layer) 13 covers the top surface and second insulator film layer (plastic layer) 14 covers the backside surface of the board.

Mutually-adjacent clockwise coils 15 and counterclockwise coils 16 are built into the flexible multi-layer board. Clockwise coils 15 have a through hole 17 matching their axis centers, while counterclockwise coils 16 have a through holes 18 matching their axis centers. Said through holes 17 and 18 are made of ferromagnetic material, such as permalloy, ferrite, or the like, and are implanted in multilayer board 12 so as to pass through the 7 layers from first layer board 12-1 to the one third of seventh layer board 12-7.

Seven layers of board 12-1 through 12-7 are each provided with ring conductor patterns 19-1 through 19-6 to encircle through hole 17, and ring conductor patterns 20-1 through 20-6 to encircle through hole 18.

Solid conductor pattern 21, which functions as the first interconnection layer, is provided on the front surface of first layer board 12-1, and solid conductor 22, which functions as the second interconnection layer, is provided on the rear surface of seventh layer board 12-7. Said solid conductor patterns 21 and 22 function as a wiring and a magnetic shield. These conductor patterns 21 and 22 are made of a non-magnetic metal, such as gold (Au), silver (Ag), or copper (Cu) among which silver (Ag) is the most preferred. Moreover, the periphery of solid conductor pattern 21, which functions as the first interconnection layer, extends in the vertical direction of multilayer board 12 so as to enclose the group of flat coils, as shown in the figure, thereby forming shield partition 21*a*. Furthermore, solid conductor pattern 21, which functions as the first interconnection layer has flux passing holes 23 and 24 to match the axis centers (magnetic pole positions) of clockwise coil 15 and counterclockwise coil 16, respectively. The flux generated from coils 15 and 16 emits outside through said flux passing holes 23 and 24.

As shown in FIG. 6(*a*), ring conductor patterns 19 (19-1 through 19-6) and 20 (20-1 through 20-6) form a true circle in a plane, and are provided with a gap 29, or a missing part of the ring, located between the first ring end 25 and the second ring end 26, which face each other.

For clockwise coil 15, first ring end (start point) 25 of the first ring conductor pattern 19-1 is electrically connected with solid conductor pattern 21, which functions as the first interconnection layer, through via (connection component) 27. Second ring end 26 of the ring conductor pattern from the first to the sixth layer, respectively, are each electrically connected with first ring end 25 of the ring conductor pattern from the second layer to the seventh layer (that is, each positioned one layer below the ring conductor layer from the first to the sixth layer) through via (connection component) 27. Second end (end point) 26 of the seventh ring conductor pattern 19-7 is electrically connected with solid conductor pattern 22, which functions as the second interconnection layer, through via (connection component) 27.

For clockwise coil 16, the first ring end (start point) 25 of the first ring conductor pattern 20-1 is electrically connected with solid conductor pattern 21, which functions as the first interconnection layer, through via (connection component) 28. The second ring ends 26 of the ring conductor pattern from the first to the sixth layer, respectively, are each electrically connected with the first ring ends 25 of the ring conductor pattern from the second layer to the seventh layer (that is, each positioned one layer below the ring conductor pattern from the first to the sixth layer) through via (connection component) 28. The second end (end point) 26 of the seventh ring conductor pattern 19-7 is electrically connected with the solid conductor pattern 22, which functions as the second interconnection layer, through via (connection component) 28.

As shown in FIG. 6(*b*), for the four ring conductor patterns 19 that are column-wise and row-wise adjacent, the positions of gaps 29 of the ring conductor patterns 19, respectively, diagonally face each other.

Shown in FIGS. 7 and 8 is the vertical cross-section and planar views of a specific sample structure of a multi-layer/multi-turn coil, which functions as a flat coil, respectively. Note that the explanation of the same components as those in the example shown in FIG. 5 is omitted by assigning the same reference numerals as those in FIG. 5 to FIG. 7.

Seven layers of board 12-1 through 12-7 are each provided with spiral conductor patterns 31-1 through 31-6 to encircle through hole 17. As shown in FIG. 8, spiral conductor patterns 31 (31-1-31-6) form a spiral shape in the planar view and each spiral conductor pattern is provided with innermost end 32 and outermost end 33.

Outermost end (start point) 32 (P1) of the first spiral conductor pattern 31-1 is electrically connected with solid conductor pattern 34, which functions as the first interconnection layer, through via (connection component) 35 (see (a) in the Figure). Outer most end 33 (P2) of the first spiral conductor pattern 31-1 is electrically connected with outermost end 33 (P2) of the second spiral conductor pattern 31-2, which is positioned in the layer below the same, through via (connection component) 35 (see (b) in the Figure). Innermost end 32 (P3) of the second spiral conductor pattern 31-2 is electrically connected with innermost end 32 (P3) of the third spiral conductor pattern 31-3, which is positioned in the layer below the same, through via (connection component) 35 (see (c) in the Figure). Following similarly from the fourth layer through the sixth layer, innermost end (end point) 32 of the sixth spiral conductor pattern 31-6 is electrically connected with solid conductor pattern 36, which comprises the second interconnection pattern, through via (connection component) 35 (see (d) in the Figure).

Either a core type or air core type is acceptable for the flat coils used in the present invention. Said selection should be determined in consideration of the required magnetization strength, flux saturation characteristics, and other factors. FIG. 9 illustrates some optimum examples of possible specific magnetic core structures.

FIG. 9 illustrates the case of using an air core (see (a) in the Figure), of using pipe core 41 mounted on the grid base (see (b1) and (b2) in the Figure), and of using vacuum core 40 (see (c) in the Figure) as possible specific magnetic core structures.

In the case of using an air core (see (a) in the Figure), since nothing exists inside the coils core axis besides air, it presumably requires no special explanation. When using pipe core 41 mounted on the grid base (see (b1) and (b2) in the Figure), a magnetic material, such as ferrite, permalloy, or the like, is used for pipe core 41. In addition, said pipe core is coupled with the four column-wise and row-wise adjacent pipe cores at its four ends in a grid pattern (see (b2) in the Figure). In the case of using a vacuum core (see (c) in the Figure), hollow pipe 40 with both of its ends blocked is used to maintain a vacuum. Said hollow pipe 40 is made of nonmagnetic metals, such as gold (Au), silver (Ag), copper (Cu), or the like, and its inside is maintained at a high vacuum pressure of approximately $10^{-9}$ Torr.

FIG. 10 illustrates an optimum design example of the coil diameter Φ and flat coil intervals. For example, if the outer diameter of ring conductor pattern is defined as coil diameter Φ as shown in FIG. 10(*a*) and the coil interval is defined as a as shown in FIG. 10(*b*), a relationship of $\Phi=3a$ is established between coil diameter Φ and coil interval a. In other words, column-wises and row-wise interval b of each adjacent core axis is expressed as $b=4a$ in the column-wise and row-wise arrayed flat coils.

Next, the working of the planar transformer with the foregoing configuration is explained. If there is adequate space between the first planar inductor 3 and the second planar inductor 5 as shown in FIG. 1, flux B, which flows from the individual coils (clockwise coils L1 and counter clockwise coils L2) of the first planar inductor 3 positioned on the power transmission side (Tx), flows into column-wise and row-wise adjacent coils L1 and L2, as shown in FIG. 11, to cause a grid-like flux distribution, which couples adjacent magnetic poles on the front surface of the first planar inductor 3 as shown in FIG. 12. Under this condition, almost no flux leaks so that various power losses caused by leakage flux can be suppressed and almost ignored. In addition, under this condition, there is no danger of metal plates becoming overheated because no eddy-current losses are caused by leakage flux, even if such metal plates were near the surface of the first planar inductor 3.

In contrast, as shown in FIG. 1, when the first planar inductor 3 and the second planar inductor 5 are placed sufficiently close together, flux B generated from individual coils L1 and L2 of the first planar inductor 3 positioned on the power transmission side (Tx) interlinks with opposing coils L1 and L2 of the second planar inductor 5 positioned on the power reception side (Rx), as shown in FIG. 13. Under this condition, flux B, which flows out of individual coils L1 and L2 of the first planar inductor 3 positioned on the power transmission side (Tx), flows into the opposing coils L1 and L2 of the second planar inductor 5 on the power reception side (Rx), and conversely, flux B, which flows out of individual coils L1 and L2 of the second planar inductor 5 on the power reception side (Rx), flows into the opposing coils L1 and L2 of the first planar inductor 3 on the power transmission side (Tx).

As a result, grid- or lattice-shaped flux distribution is formed to constitute a push-pull magnetic circuit between the first planar inductor 3 and the second planar inductor 5 and to cause almost no flux leakage, thus allowing non-contact power transmission with minimum losses.

In addition, magnetic coupling of coils between said first planar inductor 3 and second planar inductor 5 can be maintained and keeps allowing highly efficient power transmission if both inductors move or oscillate continuously, because, even if the inductors are shifted horizontally and lose matching between coils as shown in FIG. 14, it only causes them to be separated again as explained above.

Therefore, said planar transformer 1 can achieve efficient non-contact power transmission between the objects if, for example, the first and second planar inductors 3 and 5 are attached by adhesive means or the like, to detachable paired objects 2 and 4, respectively, and mounted as shown in FIG. 1, simply by placing said objects close together, and the flux emitted from the flat coils will be trapped in between both solid conductor patterns and flow in or out only through flux-passing holes 23 and 24 positioned on the surface because first and second interconnection layers 3*b* and 3*c*, which sandwich flat coil carry layers 3*a* and 5*a* and face each other, are each non-magnetic solid conductor layers, so as not to easily cause leakage flux or electromagnetic interference to peripheral equipment.

In addition, the required electrical energy can easily be secured by increasing or decreasing the sheet areas that face each other, and there is a greater capacity design freedom because first and second planar inductors 3 and 5, which comprise said planar transformer 1, can be configured in a thin sheet form, and because multiple flat coils 6 and 9 that are distributed on the surface are electrically connected in parallel between interconnection layers 3*b* and 5*b* on the front side of the sheet and interconnection layers 3*c* and 5*c* on the backside of the sheet.

Note that the foregoing explains applying the invention to a planar transformer, however this obviously depicts just one embodiment of the present invention.

In other words, the basic configuration of the planar inductor of the present invention comprises a plurality of flat coils, a flat coil carry layer which carries said flat coils arrayed in a plane, a first interconnection layer provided on one side of the flat coil carry layer, and a second interconnection layer provided on the other side of the flat coil carry layer, wherein each flat coil start point is connected through the first interconnection layer and the each flat coil end point is connected through the second interconnection layer, whereby a parallel electrical connection of the flat coils between the first and the second interconnection layers is achieved.

Other than planar transformers for non-contact power transmission, there are a number of conceivable applications of said planar inductors, including inductance devices (L) in electrical circuits, planar antennas, and, further more, linear motors with a series of inductors laid along with a track, power feeding equipment for the power supply inside an elevator with inductors mounted on the elevator chute walls and the opposing outside elevator walls. The size, structure, and materials thereof can be properly used according to each application, respectively.

For example, in a conventional method, an electrical circuit including inductance device L was mounted on a printed-circuit board. In this case, it was necessary to consider the magnetic effect caused by leakage flux upon other circuit device when the inductance device (chip) is mounted on the printed-circuit board. However, the planar inductor of the present invention allows the printed circuit board itself to comprise a planar inductor as well as it allows an extremely small amount of leakage flux so that the surface of the circuit board can be effectively used for mounting circuit components and there is almost no magnetic effect upon other circuit devices to be considered.

And, if the planar inductor of the present invention is applied to a circuit component inductor, the solid conductor patterns that function as the first interconnection layer and second interconnection layer have no flux-passing hole so as to allow the flux to be confined between these two solid conductor layers and not to leak outside.

Moreover, if the planar inductor of the present invention is applied to an inductance device (L) incorporated into an LSI, the flat coil carry layer, the first and second interconnection layers, and so on, which comprise the planar inductor of the present invention can each be made on a silicon wafer by using semiconductor fabrication technologies.

In addition, as shown in FIG. 15, if the backside of the interconnection layer, which comprises the planar inductor, is formed as line pattern 42 which connects the flat coil end-points in the planar view and includes antenna pattern 43 (see FIG. 16) with given tuning characteristics, a highly efficient planar antenna can be configured. In this application, it is desirable that all the flat coils have the same winding direction.

Furthermore, if the planar inductor of the present invention comprises a flexible sheet, as shown in FIG. 17, a flat sheet wound up into a roll can be rolled out and cut to the required size by inserting suitable separation cut-off lines 44 in advance. In this case, within each area divided by two cut lines 44, multiple fiat coils between the top of the interconnection layer and the backside of the intersection layer are electrically connected in parallel and column-wise and row-wise dispersed, thus no extra ingenuity is required for the wiring and coil layout. But, it is reasonable that terminals, which lead to the wiring conductors on the top of the interconnection layer and the backside of the interconnection layer, are pulled out from the edges of each area to be cut off, to allow easy terminal wiring.

The foregoing planar inductors have either a circular or spiral-ring shape conductor pattern, as shown in FIGS. 5 through 8. However, it has been found that there are optimum shapes according to the applications and required characteristics of planar inductors.

(1) Square Ring or Square Spiral

As shown in FIG. 18(*a*), if circular ring or circular spiral conductor patterns are column-wise and row-wise dispersed, the current flows in the same directions in the adjacent conductor patterns at only one point on the circumference of each of these conductor patterns, in which the circumference intersects the straight line which connects the magnetic cores of these conductor patterns. Therefore, planar inductors that use circular ring or circular spiral conductor patterns have one disadvantage in that their self-inductance is relatively small as well as they are likely to cause electromagnetic interference.

In contrast, as shown in FIG. 18(*b*), if square ring or square spiral conductor patterns (in this example, equilateral rectangular ring or equilateral rectangular spiral conductor patterns) are column-wise and row-wise dispersed, there are mutually parallel linear conductor sections between the adjacent coils. Therefore, if planar conductors use such equilateral rectangular ring or equilateral rectangular spiral conductor patterns, they have one advantage that their self-inductance increases while they are likely to cause less electromagnetic interference. This result is the same for ring or spiral conductors in other shapes, such as a triangle, hexagon, or octagon.

In particular, in a layout of equilateral rectangular ring or spiral conductor patterns, the matching current direction between the adjacent conductor patterns can be maintained even if the number of conductor patterns is increased in any direction in the periphery of each conductor pattern. Therefore, equilateral rectangular ring or spiral conductor pattern is useful for manufacturing wide-area planar inductors (if individually used as inductance devices).

(2) Hexagonal Ring or Hexagonal Spiral

If a pair of planar inductors facing each other is used to configure a planar transformer, the power transmission efficiency significantly decreases depending on the positioning of both of these planar inductors, unless the positions of magnetic cores (North magnetic pole and South magnetic pole, South magnetic pole and North magnetic pole) perfectly match.

In such cases, if the equilateral hexagon ring or equilateral hexagon spiral conductors are applied to each of the facing planar inductors, the power transmission efficiency can be favorably maintained regardless of the positions of both planar inductors. If the power transmission efficiency at the perfectly aligned position shown in FIG. 19(*a*) is 100, the power transmission efficiency at the maximum shift position shown in FIG. 19(*b*) is approximately 90. In other words, even if both planar inductors are placed in any position, the decrease in power transmission efficiency at the maximum shift position can be held to approximately 10% of the maximum power transmission efficiency. Accordingly, in cases where a transformer comprises a pair of planar inductors facing each other, if the equilateral hexagon ring or equilateral hexagon spiral coils are used for said planar inductors, good power transmission efficiency can be maintained regardless of the positions of both planar inductors. Note that in this figure, N and S are the North pole and South pole of the pair of planar inductors facing each other, and (N) and (S) are the North pole and South pole of the other planar inductors.

(3) Series of Pairs of Reverse Rings or Reverse Spirals (S-Shape)

As shown in FIGS. 20(*a*) through (*c*), if the outermost periphery of two adjacent reverse coils are placed on perpendicular bisectors a1, a2, an of the line segment which connects the magnetic cores of a pair of these coils of each pattern, the coil pattern can be maintained exactly in the same shape to form a multi-layer coil structure, and a planar inductor with little flux leakage and high inductance can be achieved.

However, if the outermost periphery of two adjacent reverse coils are placed on perpendicular bisectors a1, a2, an of the line segment that connects the magnetic cores of a pair of these coils of each layer, the via position of each layer must be shifted to the left, one layer at a time, in the figure for each unit length of via on perpendicular bisectors a1, a2, an, as shown in FIGS. 20(*a*) through (*c*), because the vias provided for connecting the layers interfere with each other between the adjacent coils. In other words, in this type of structure, the number of layers (or the total number of coil turns) to be stacked will be restricted to the length of the boundary conductor section (in the figure, one side of the hexagon) positioned on the perpendicular bisectors.

Note that in FIGS. 20(*a*) through (*c*), p11 and p12 are the start point and end point of one adjacent coil (counterclockwise) on the uppermost layer (layer 1) while q11 and q12 are the start point and end point of the other adjacent coil (clockwise) on layer 1; p21 and p22 are the start point and point of one adjacent coil (counterclockwise) on the layer one layer below the uppermost layer (layer 2), while q21 and q22 are the start point and end point of the other coil (clockwise) on layer 2; and pn1 and pn2 are the start point and end point of one adjacent coil (counterclockwise) on the lowermost layer (layer n), while qn1 and qn2 are the start point and end point of the other coil (clockwise) on layer n.

FIG. 21 shows the coil pattern in which the number of such coil pattern layers to be stacked is not restricted. It is evident in the figure that, on said coil pattern, the adjacent equilateral hexagonal ring or spiral reverse coil patterns are connected on line segments a21 and a22 of perpendicular bisectors that connects the magnetic cores of both adjacent coils, to farm a conductor pattern in reverse-S shape on the uppermost layer and one conductor pattern in S-shape on the layer one layer below the upper most layer, respectively.

If in such an S/reverse-S-shape conductor pattern, the number of coil layers to be stacked can be significantly increased because interference of the vias connecting the upper and lower layers is eliminated to allow the planar inductor to increase its self-inductance as well as to allow the manufacturing cost to be reduced because the total number of vias required on each layer can be reduced to a half of that in the example shown in FIG. 20.

In other words, the first coil on the uppermost layer, the layer one layer below the uppermost layer, the lowermost layer is connected in the order of p11→p12→p21→p22→→pn1→Pn2, and the second coil is connected in the order of q11→q12→q21→q22→→qn1→qn2. As a result, it is evident from the figure that the via positions are shifted over to the left in order to avoid interference of the vias between upper and lower layers. And, the via positions have reached the left end of the boundary conductor section on the lowermost layer. In other words, the number of coil layers are limited by the length of the boundary conductor section.

In contrast, as shown in FIG. 21, in multi-layer coil conductor patterns, two vias in the same location no longer interfere each other and the via locations stay constant across all pattern layers because a pair of reverse coil conductor patterns are connected to form one conductor pattern in an S or reverse-S shape. Therefore, the coils are connected in order of r11→r12→r21→r22 from the uppermost layer to the lowermost layer. As a result, it becomes possible to stack the coil conductor patterns in any required number, regardless of the relationship between the length of the boundary conductor section and the unit length of each via to obtain a large inductance. Note that in FIGS. 21(*a*) and (*b*), r11 and r12 are the start point and end point of a conductor in a reverse-S shape on the uppermost layer, and r21 and r22 are the start point and end point of a conductor pattern in an S-shape on the layer one layer below the uppermost layer.

FIG. 22 illustrates an equivalent circuit diagram showing the connection between each flat S/reverse-S-shape coil conductor pattern and the interconnection layer. Note that the explanation of the same components as those in the example shown in FIG. 4 is omitted by assigning the same reference numerals as those in FIG. 4 to FIG. 22.

As shown in FIG. 22, said planar inductor has flat coil carry layer 5*a* which carries multiple dispersed flat coils 9, 9 . . . in the planar view, a first interconnection layer 5*b* provided on one side of flat coil carry layer 5*a*, and a second interconnection layer 5*c* provided on the other side of the flat coil carry layer. Note that in the figure, 5*e* and 5*d* are plastic insulator films.

The start point of each flat coil 9 is connected through the first interconnection layer 5*b* and the end point of each flat coil 9 is connected through the second interconnection layer 5*c*. This configuration allows the parallel electrical connection of multiple flat coils 9, 9 . . . dispersed in a plane between the first interconnection layer 5*a* and the second interconnection layer 5*b*.

In this example, flat coil carry layer 5*a* comprises a multilayer substrate with n layers consisting of first layer R1, second layer R2, . . . nth layer Rn. On the first layer R1, reverse-S-shape conductor patterns 91, each fowled by serially connecting a clockwise equilateral hexagonal spiral pattern 91*a* and a counterclockwise equilateral hexagonal spiral pattern 91*b* as shown in FIG. 21(*a*), are densely dispersed side by side as shown in FIG. 19. On second layer R2, S-shape conductor patterns 92, each formed by serially connecting a clockwise equilateral hexagonal spiral pattern 92*a* and a counterclockwise equilateral hexagonal spiral pattern 92*b* as shown in FIG. 21(*b*), are densely dispersed side by side as shown in FIG. 19. In the same manner, on the third and fourth layers, reverse-S-shape and S-shape conductor patterns are densely dispersed side by side. Finally on the lowermost or nth layer, S-shape conductor patterns are densely dispersed side by side.

Reverse-S/S-shape conductor patterns on layers 91, 92, . . . , and 9*n* are serially connected between these layers, while the clockwise equilateral hexagonal spiral patterns and counterclockwise equilateral hexagonal spiral patterns are stacked from top to bottom with their magnetic cores aligned, respectively. With this configuration, one flat coil 9 is formed to allow push-pull operation to be performed on the magnetic circuit as previously explained in FIGS. 11 and 12.

Note that the clockwise and counterclockwise spiral patterns which comprise Reverse-S/S-shape layers 91, 92, . . . 9*n* are not limited to an equilateral hexagon but a variety of equilateral polygons, such as an equilateral triangle, an equilateral square, and an equilateral octagon can be used. Based on the trials conducted by the inventor, et al., when assuming an application (for example, a location-free non-contact charging of mobile phones, etc.) as a transformer with the primary side and secondary side in undefined positions, it was confirmed that an equilateral triangle was optimal for the clockwise and counterclockwise spiral patterns comprising reverse-S/S-shape conductors patterns 91, 92, . . . 9*n* as shown in FIG. 23.

In addition, in the case of using an equilateral triangle, there are two types of layout of such reverse-S/S-shape conductors patterns 91, 92, . . . 9*n* to be considered: (1) a layout in which parallelograms each formed by combining four conductor patterns are dispersed side by side in order as shown in FIGS. 24 (*a*), and (2) a layout in which equilateral hexagons each formed by combining three conductor patterns are dispersed side by side in order as shown in FIG. 24 (*b*).

Accordingly, it was confirmed that the current vector direction becomes identical on all sides to minimize the flux leakage and maximize the self-inductance between adjacent reverse-S/S-shape conductor patterns, if a equilateral triangle is used for clockwise and counterclockwise spiral patterns comprising reverse-S/S-shape conductors patterns 91, 92, . . . 9*n* as shown in FIG. 23 and a pattern layout shown in FIG. 24 (*a*) or (*b*).

POSSIBILITIES IN INDUSTRIAL APPLICATIONS

With the planar inductor invention, the voltage applied to each coil would not change even if the number of coils is increased or decreased because, if deriving, e.g., feeding terminals, which are extended from the first and second interconnection layers, are connected with an AC or RF power supply, the supply voltage can be applied as-is to each flat coil. Therefore, the number of coils can be increased or decreased without restricting the coil characteristics, such as the number of coil turns or the coil diameter, a planar inductor with a given area can easily be designed, the required power to be transmitted can be adjusted by maintaining a coil density per a given area and by increasing or decreasing the area itself when positioning a pair of planar inductors facing each other to carry out non-contact power transmission, and, furthermore, separation cut-off lines can be set with relative freedom since each coil is individually supplied power from the power supply.

BRIEF DESCRIPTION OF THE FIGURES

FIG. 1 Exploded perspective view showing an example of use as a planar transformer.

FIG. 2 Vertical sectional view of first and second planar inductors facing each other.

FIG. 3 Layout showing flat coils dispersed in a plane.

FIG. 4 Equivalent circuit showing the connection between each flat coil and the interconnection layers.

FIG. 5 Vertical sectional view showing a specific configuration of a multi-layer/single turn coil that functions as a flat coil.

FIG. 6 Planar view of ring-shaped conductor pattern.

FIG. 7 Vertical sectional view showing a specific configuration of a multi-layer/multi-turn coil that functions as a flat coil.

FIG. 8 Planner view of spiral-shape conductor patterns.

FIG. 9 View illustrating the flat coil cores.

FIG. 10 View illustrating preferred design examples of the flat coils.

FIG. 11 View illustrating flux channel of a planar transformer with a sufficient space between the first and second planar inductors.

FIG. 12 Planner view illustrating flux distribution on the first planar inductor surface in a planar transformer with a sufficient space between the first and second planar inductors.

FIG. 13 View illustrating the flux channel of a planar transformer with the first and second planar inductors close enough.

FIG. 14 View illustrating the flux channel of a planar transformer with the positions of the first and second planar inductors shifted horizontally.

FIG. 15 Planar view showing the backside interconnection layer which comprises the planar inductor.

FIG. 16 View illustrating some sample antenna patterns.

FIG. 17 View illustrating a planar inductor comprising a flexible sheet with cut-off lines.

FIG. 18 View illustrating a pattern with mutually parallel linear conductor sections between the adjacent coils.

FIG. 19 View illustrating coil patterns that can maintain power transmission efficiency.

FIG. 20 View illustrating problems caused by a multi-layer conductor using individual coils.

FIG. 21 View illustrating optimum multi-layer conductor patterns.

FIG. 22 An equivalent circuit diagram showing the connection between each flat coil conductor pattern and the interconnection layer.

FIG. 23 View showing another example of reverse-S/S-shape conductor patterns.

FIG. 24 View showing two types of layout for reverse-S/S-shape conductor patterns.

EXPLANATION OF REFERENCE NUMERALS

Figure 1:
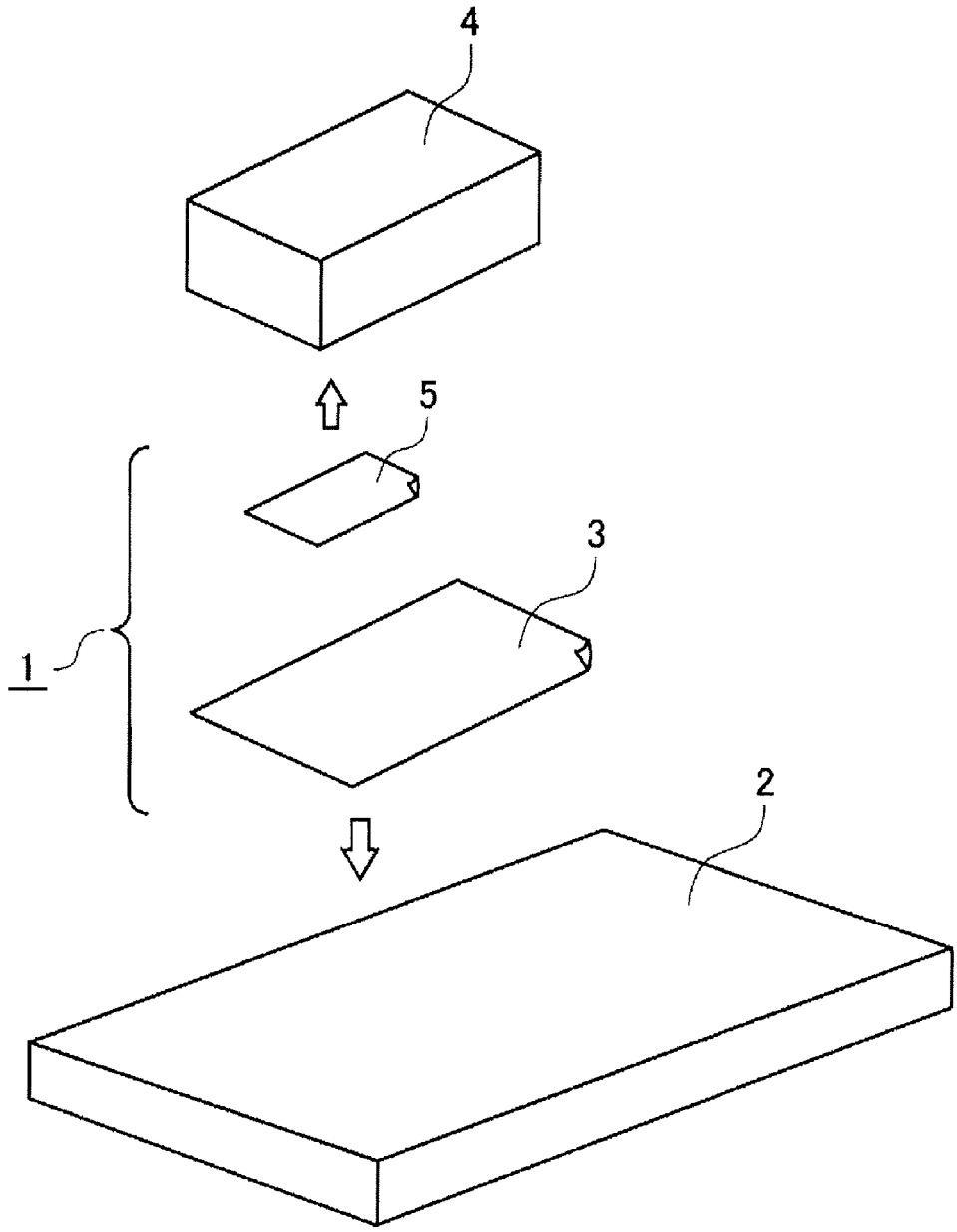
[FIG. 1]
Figure 2:
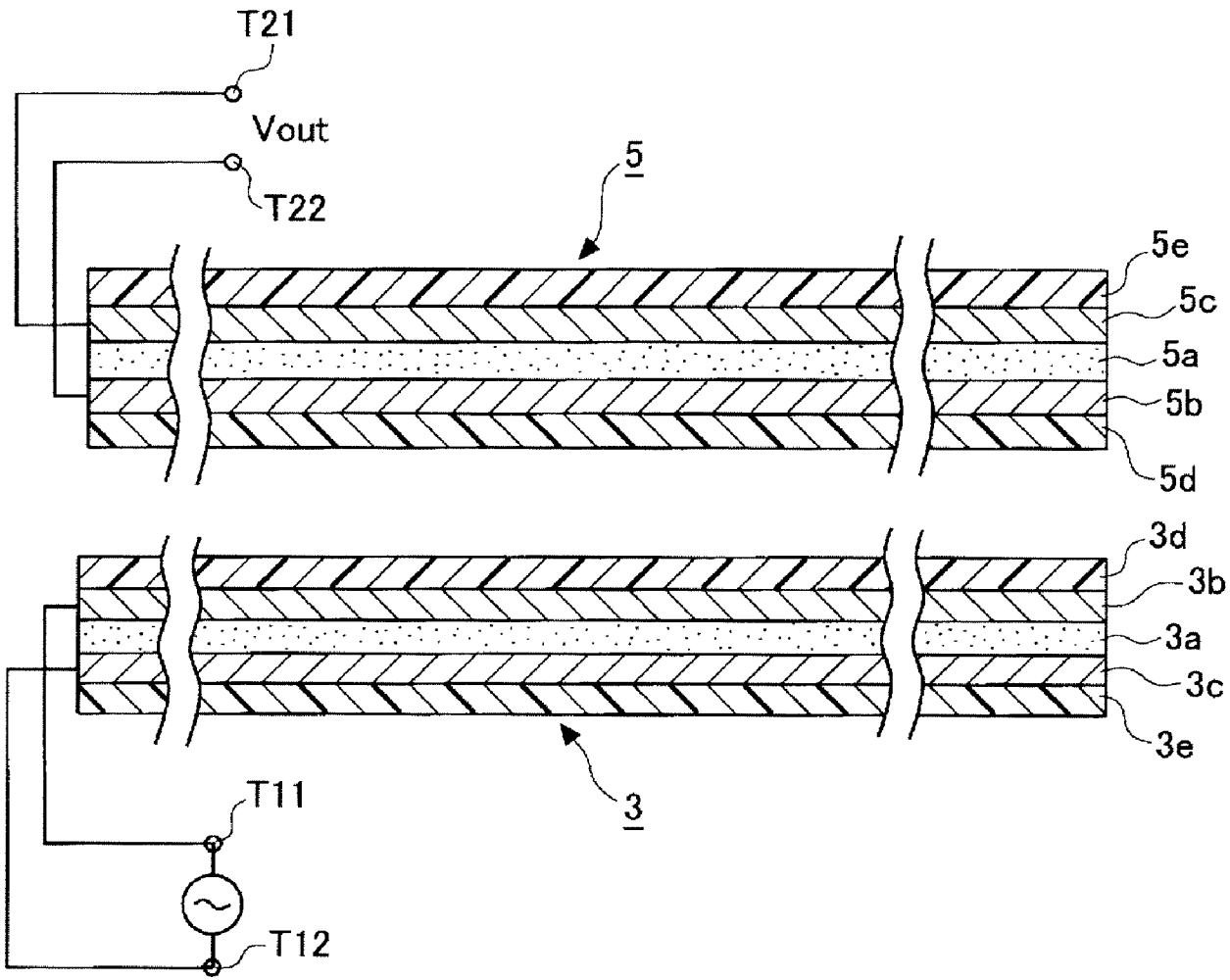
[FIG. 2]
Figure 3:
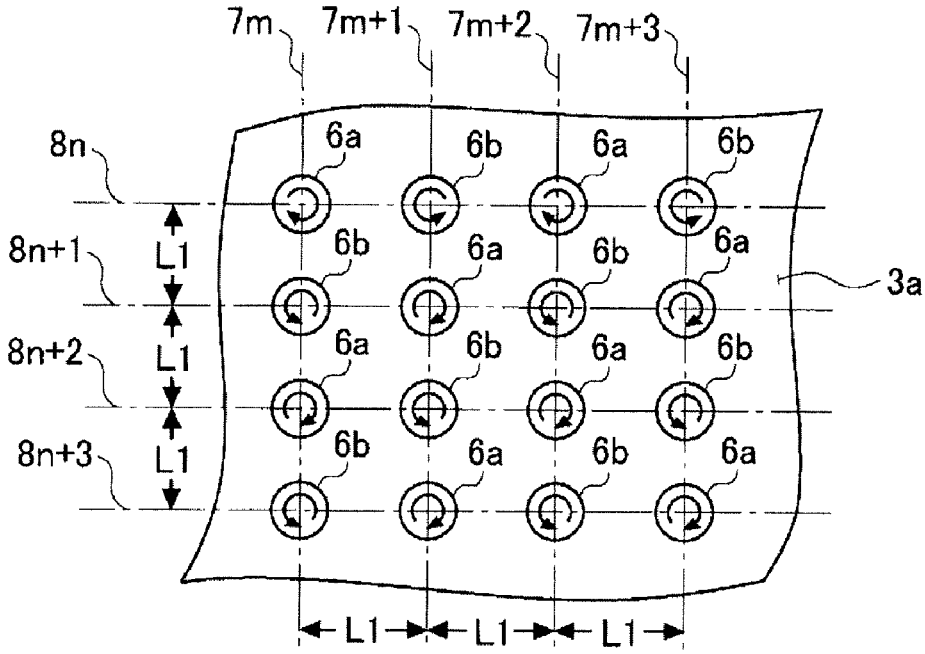
[FIG. 3]
Figure 3:
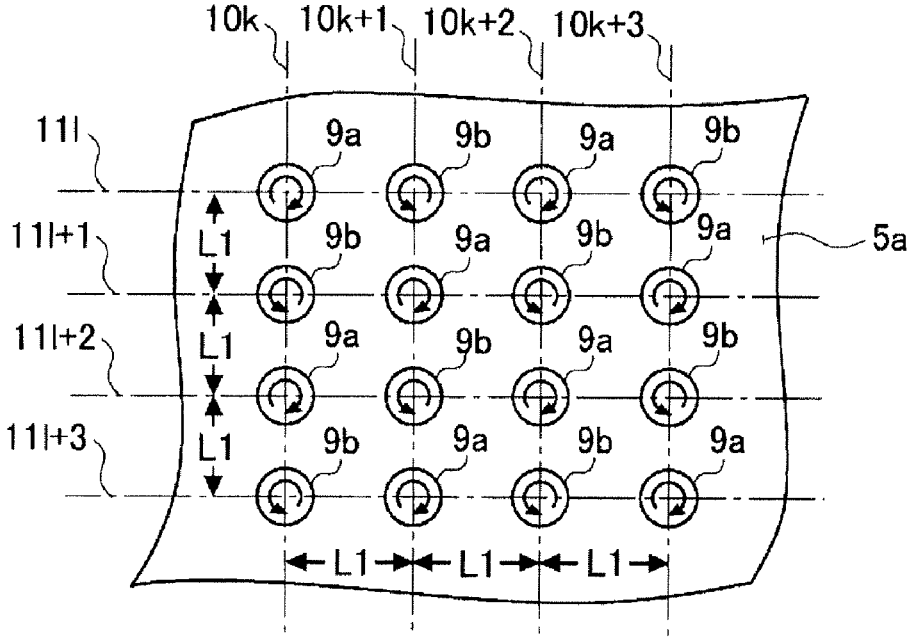
Figure 4:
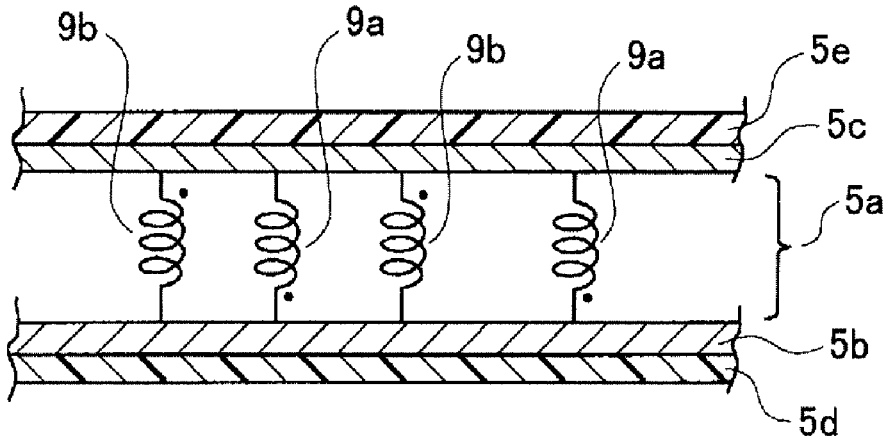
[FIG. 4]
Figure 4:
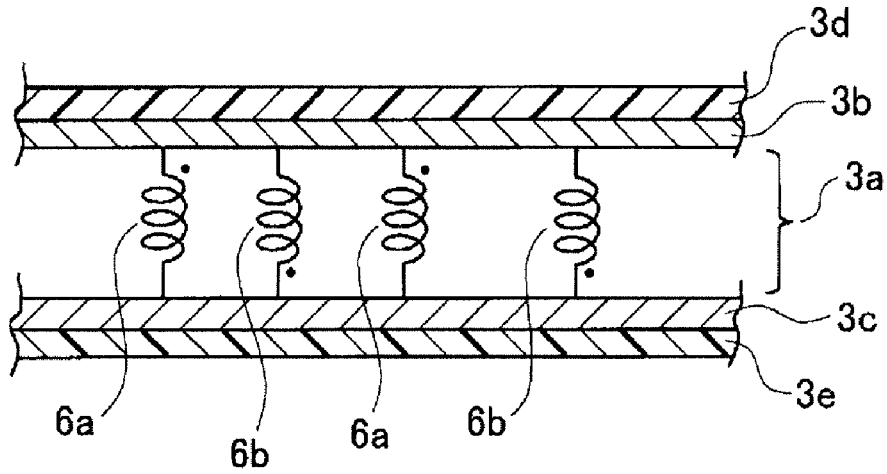
Figure 5:
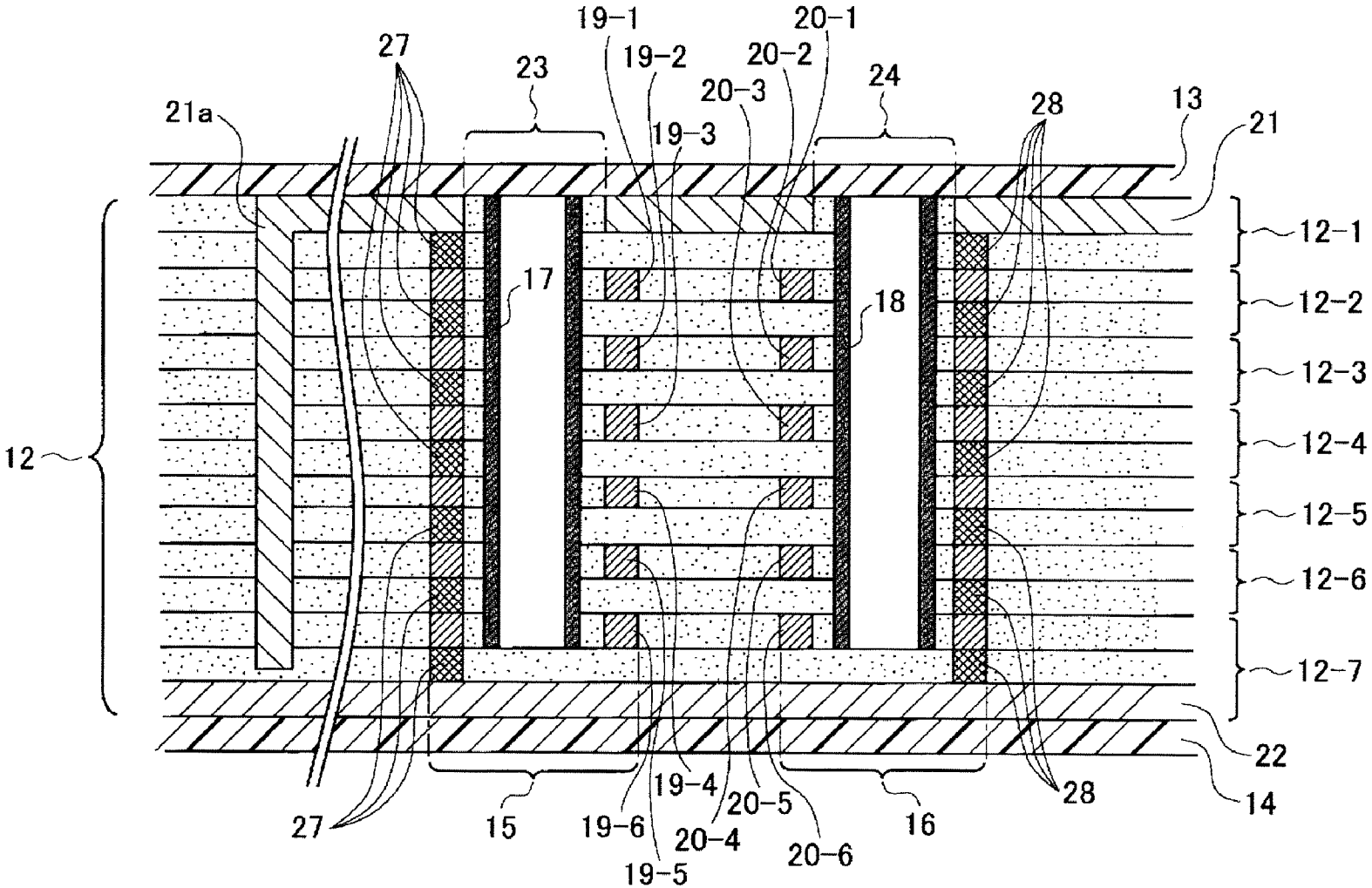
[FIG. 5]
Figure 6:
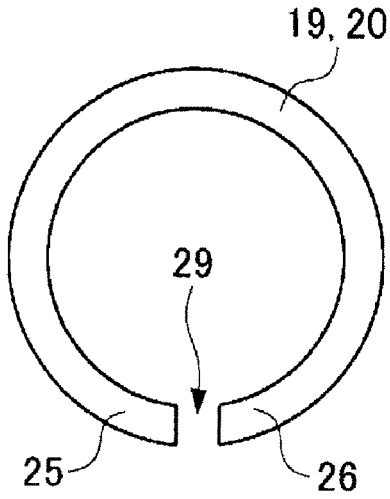
[FIG. 6]
Figure 6:
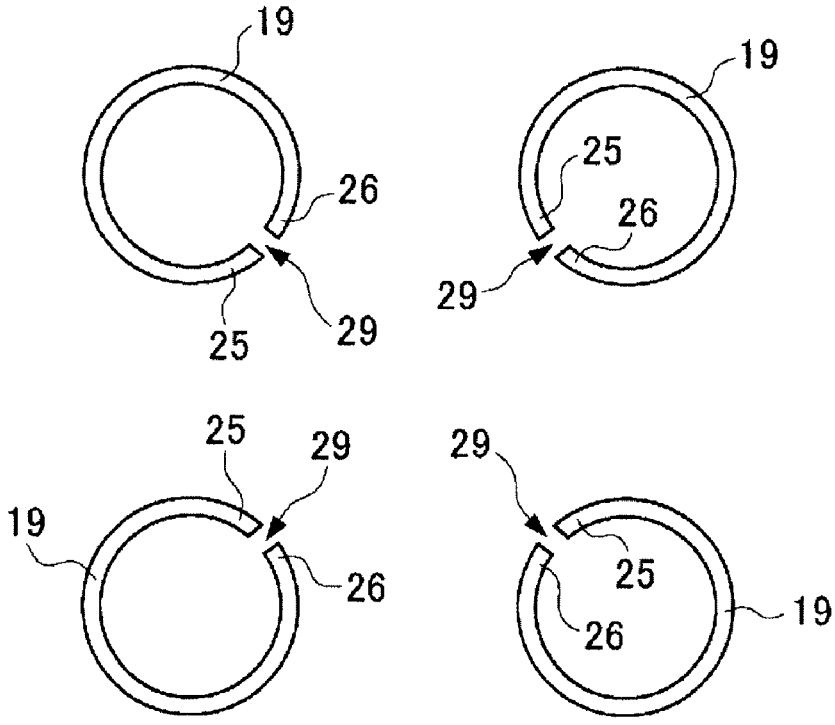
Figure 7:
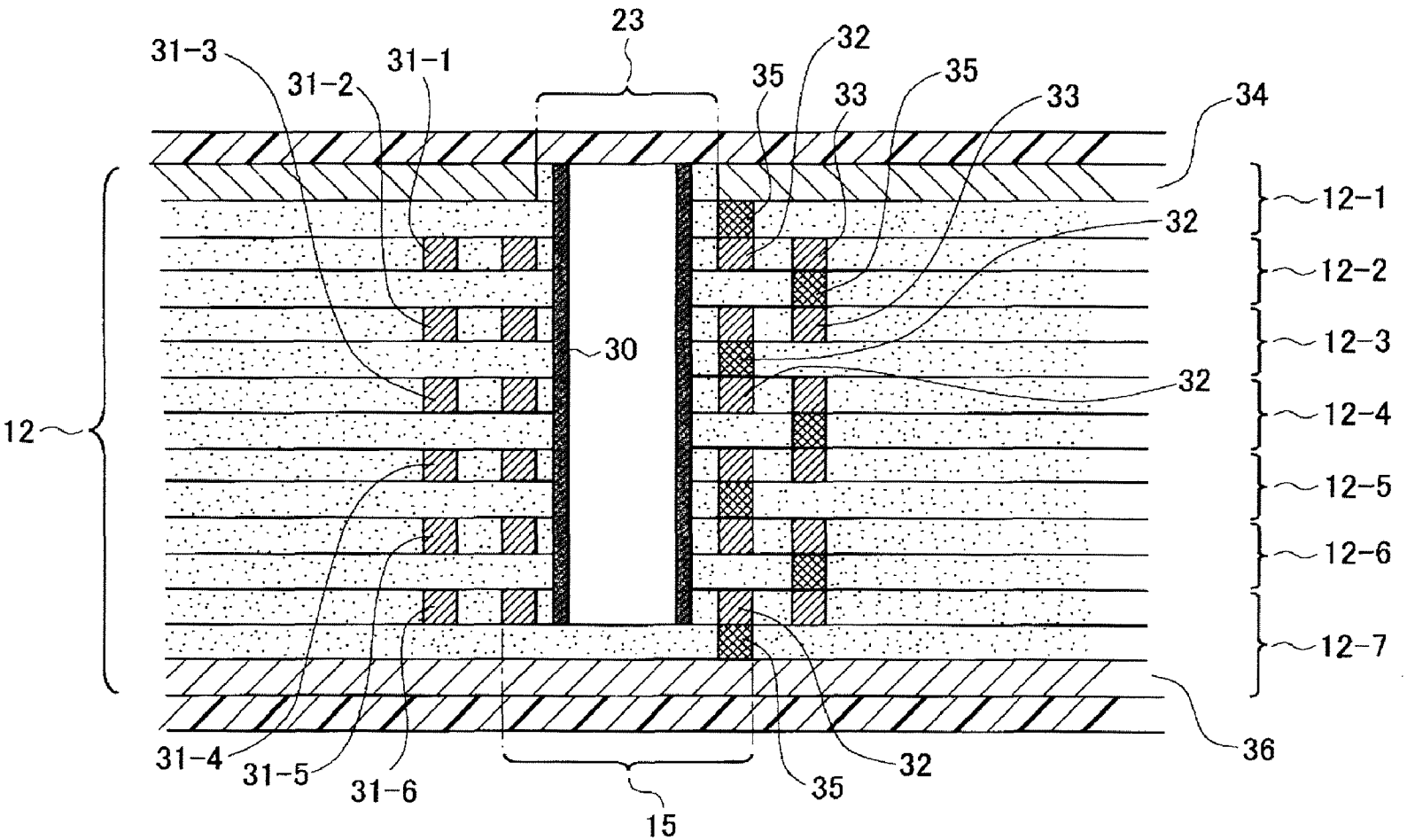
[FIG. 7]
Figure 8:
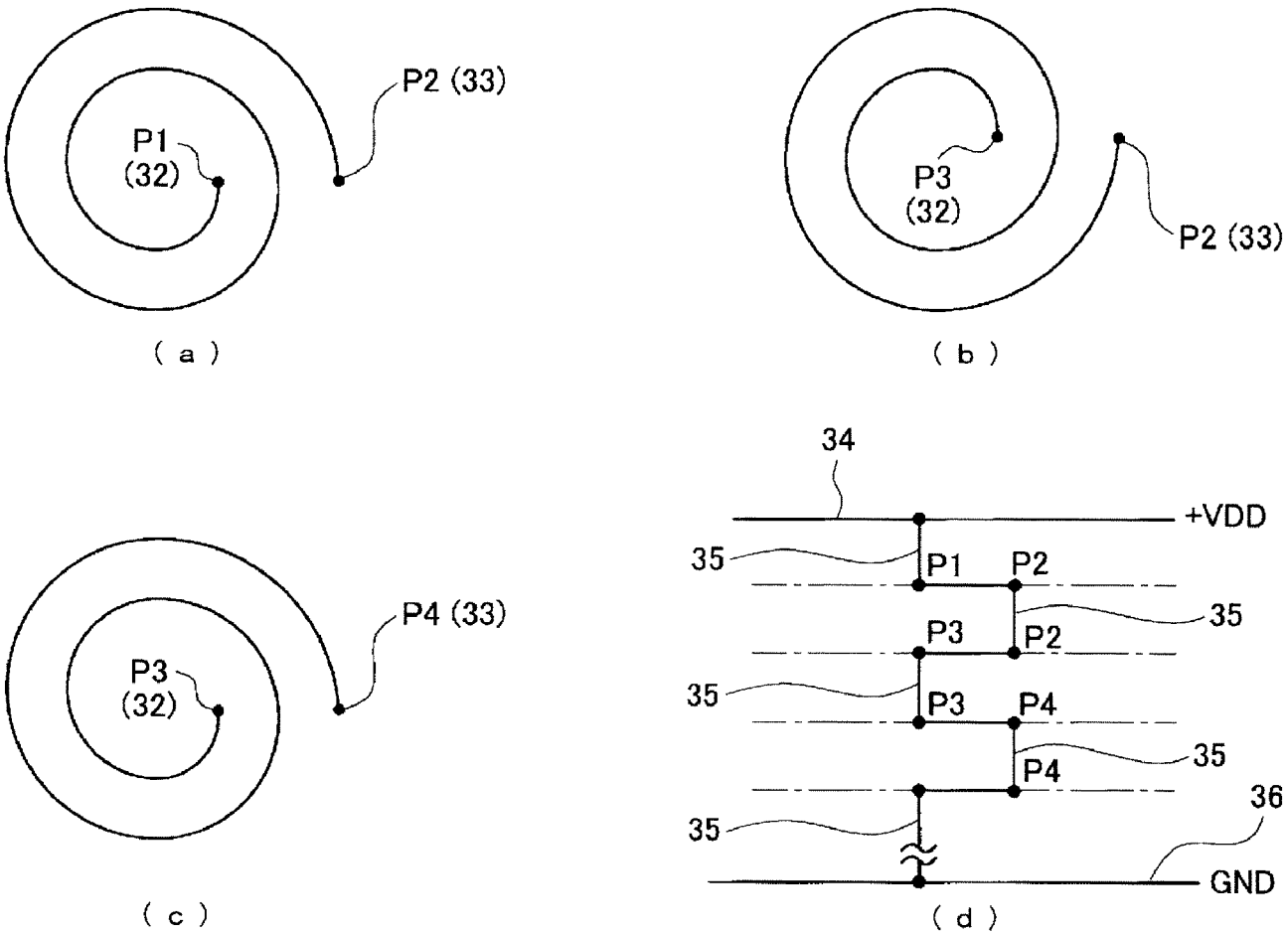
[FIG. 8]
Figure 9:
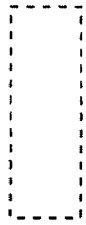
[FIG. 9]
Figure 9:
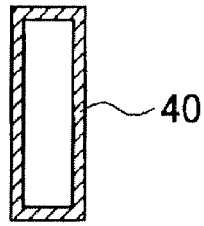
Figure 9:
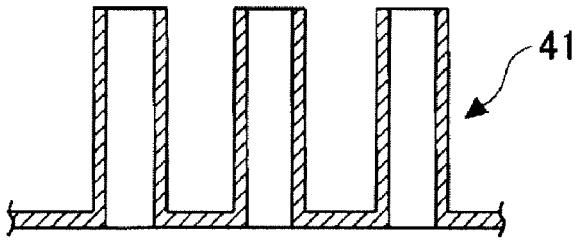
Figure 9:
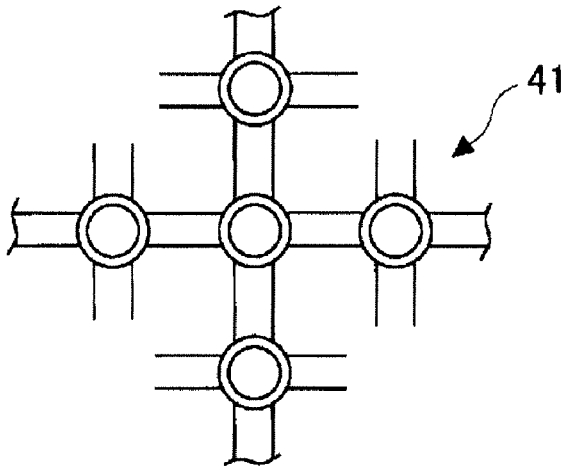
Figure 10:
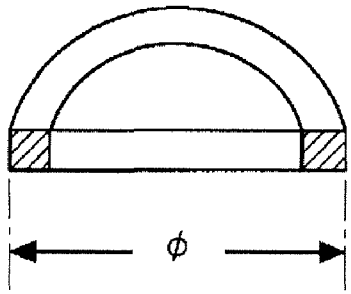
[FIG. 10]
Figure 10:
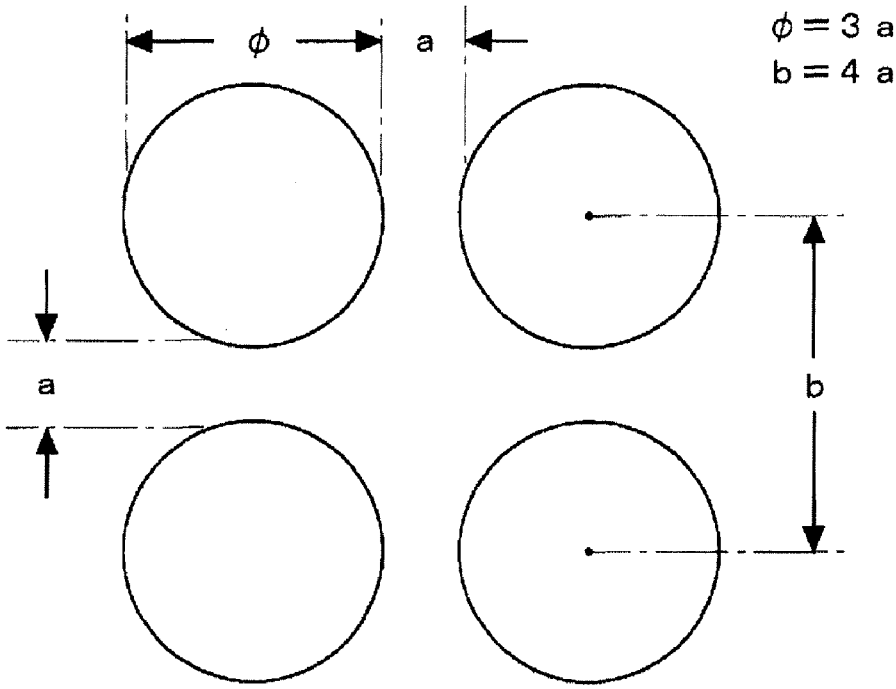
Figure 11:
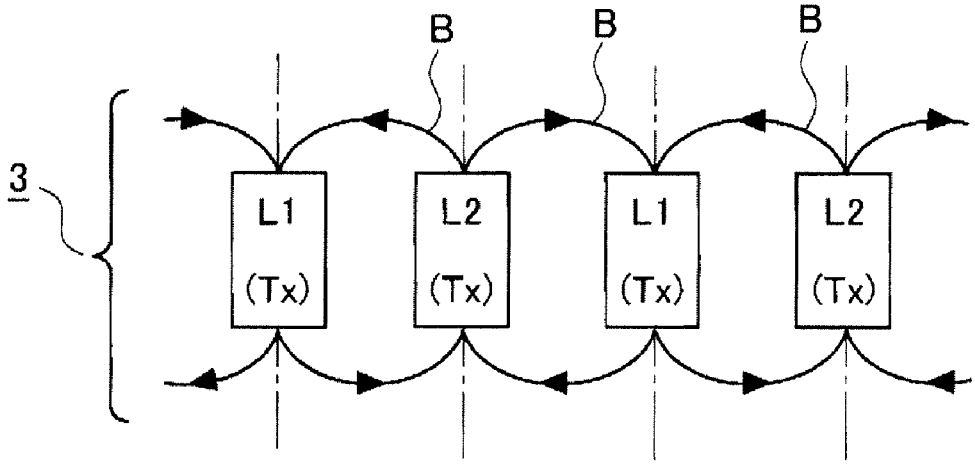
[FIG. 11]
Figure 12:
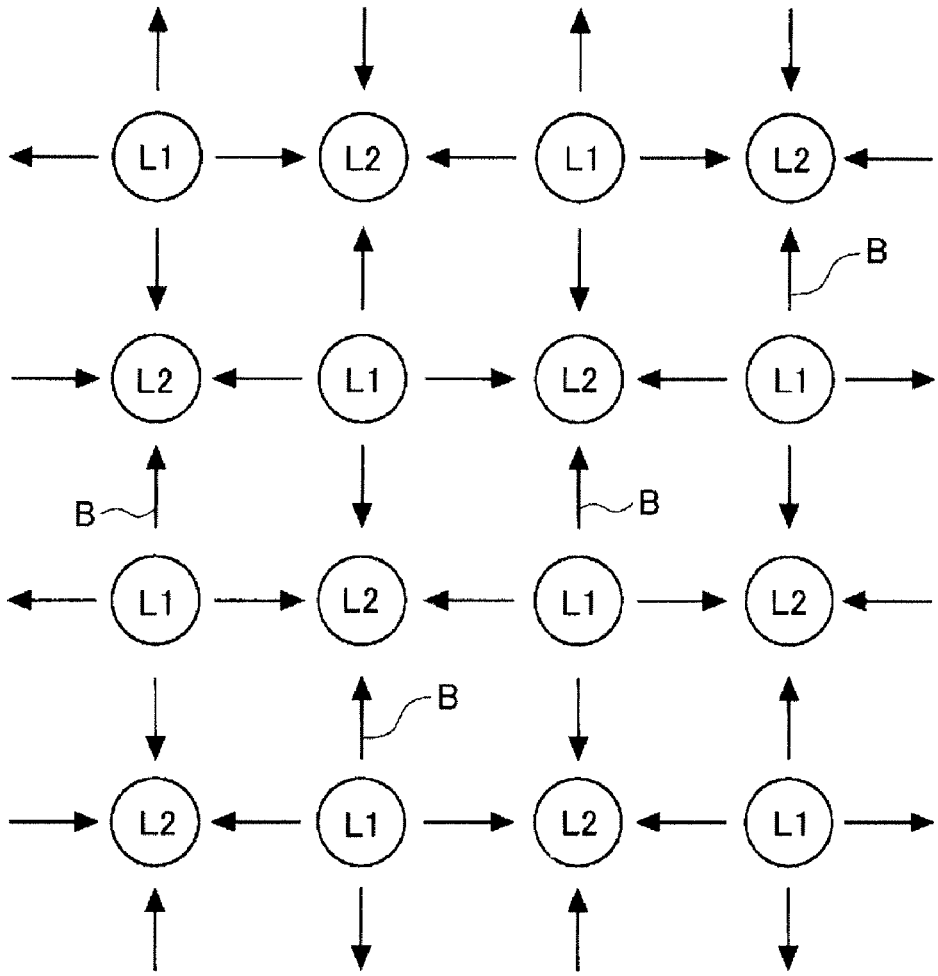
[FIG. 12]
Figure 13:
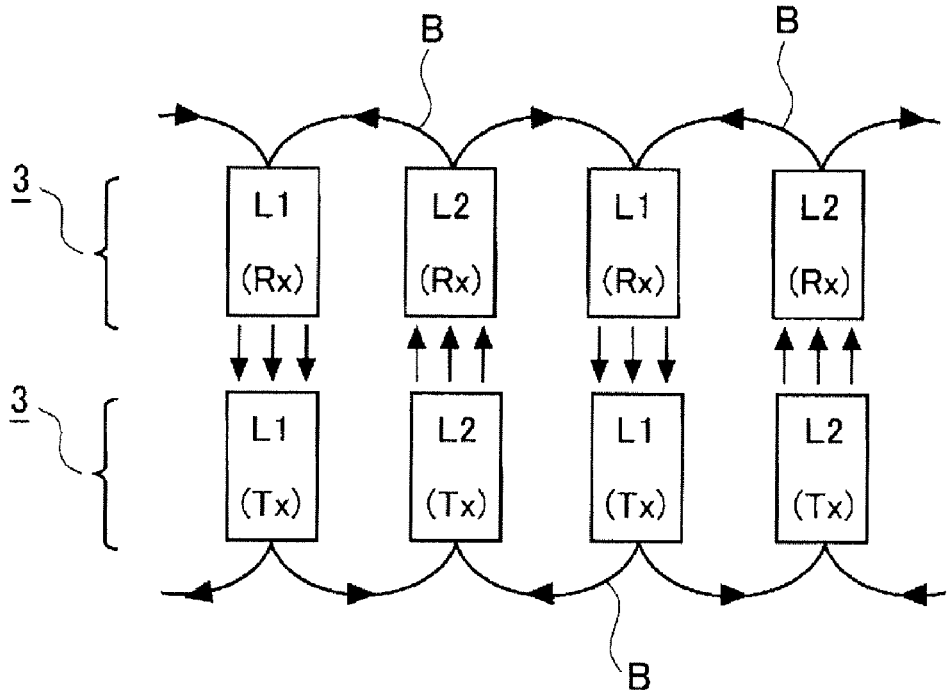
[FIG. 13]
Figure 14:
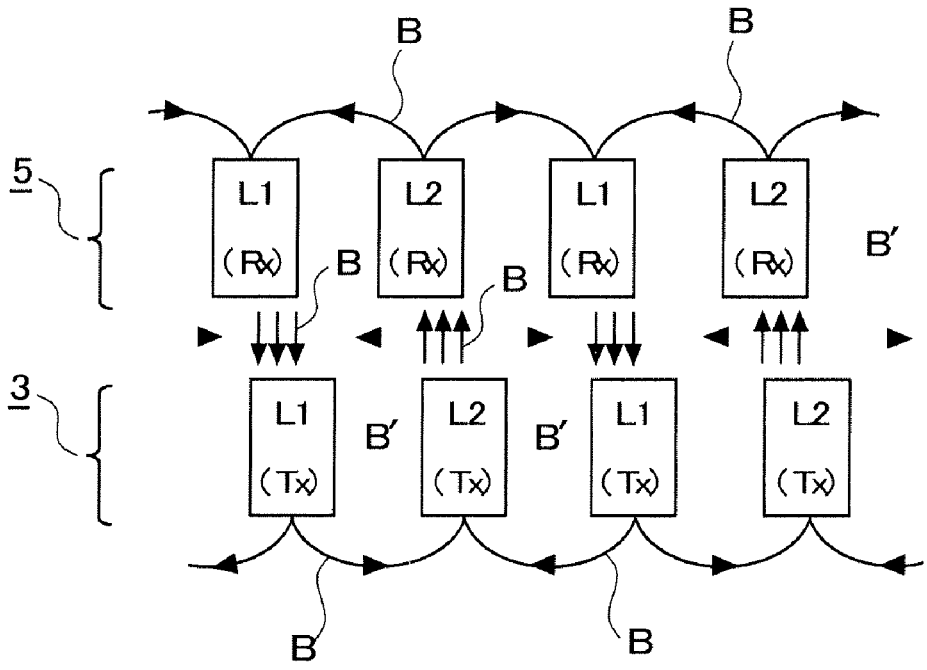
[FIG. 14]
Figure 15:
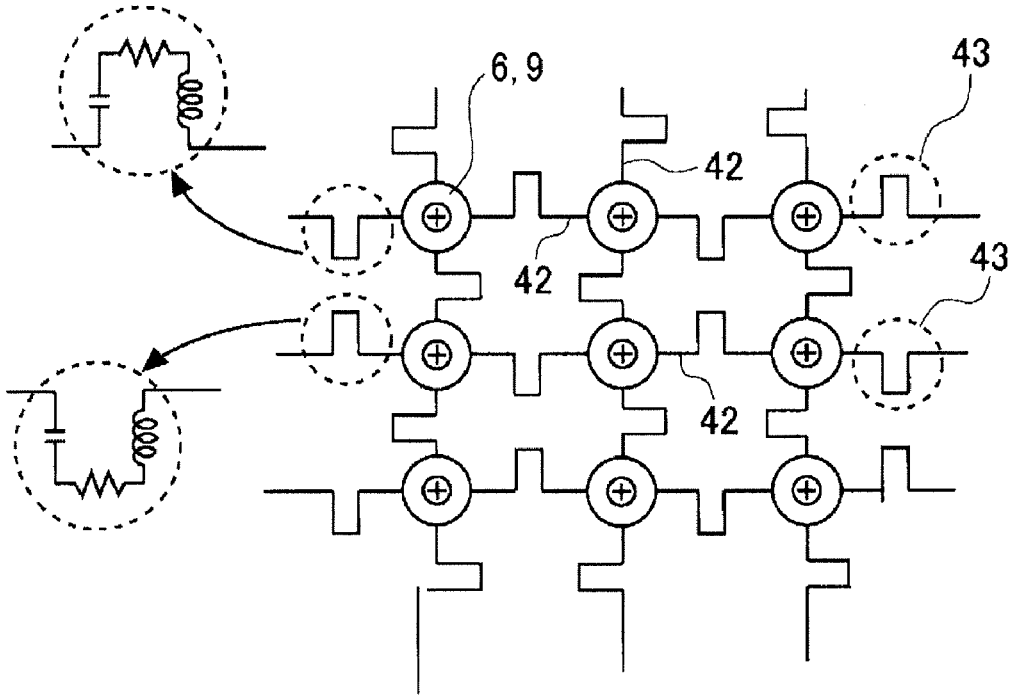
[FIG. 15]
Figure 15:
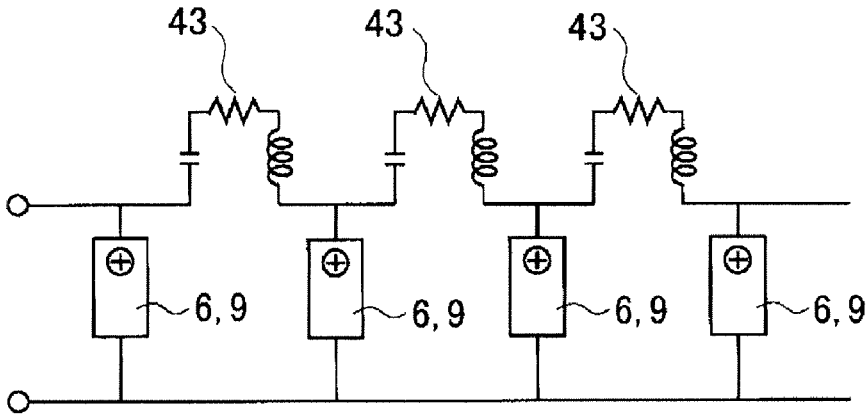
Figure 16:
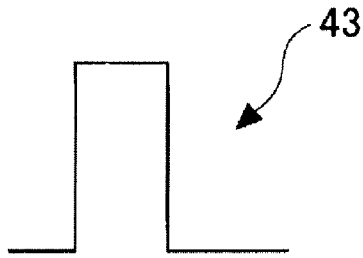
[FIG. 16]
Figure 16:
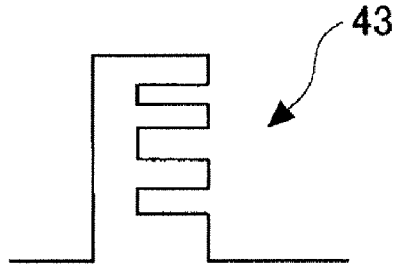
Figure 16:
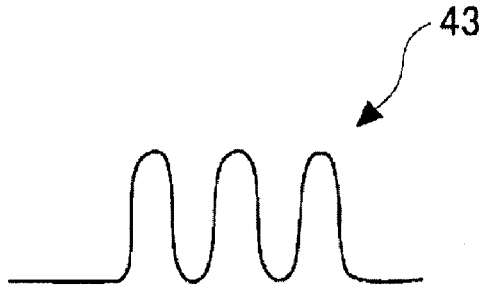
Figure 17:
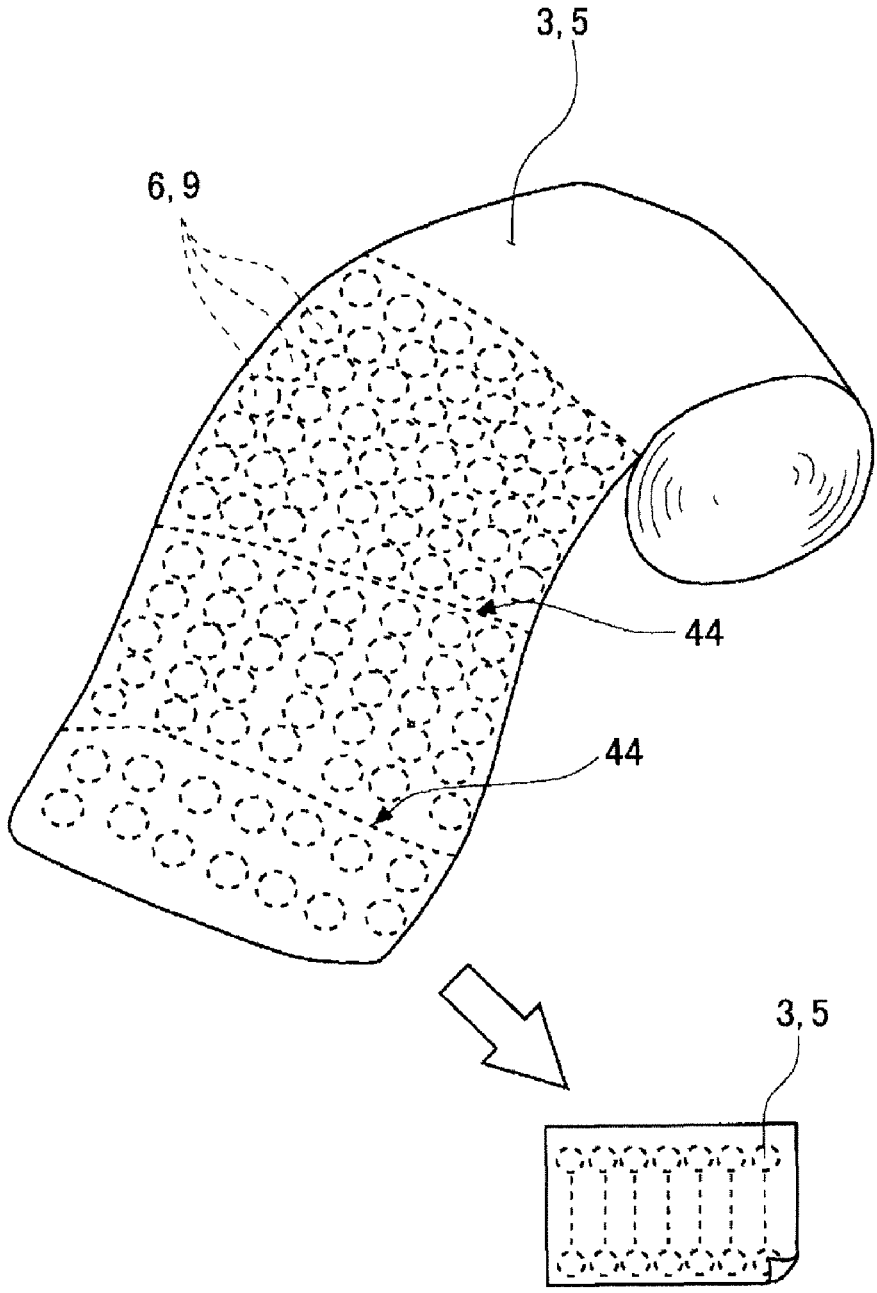
[FIG. 17]
Figure 18:
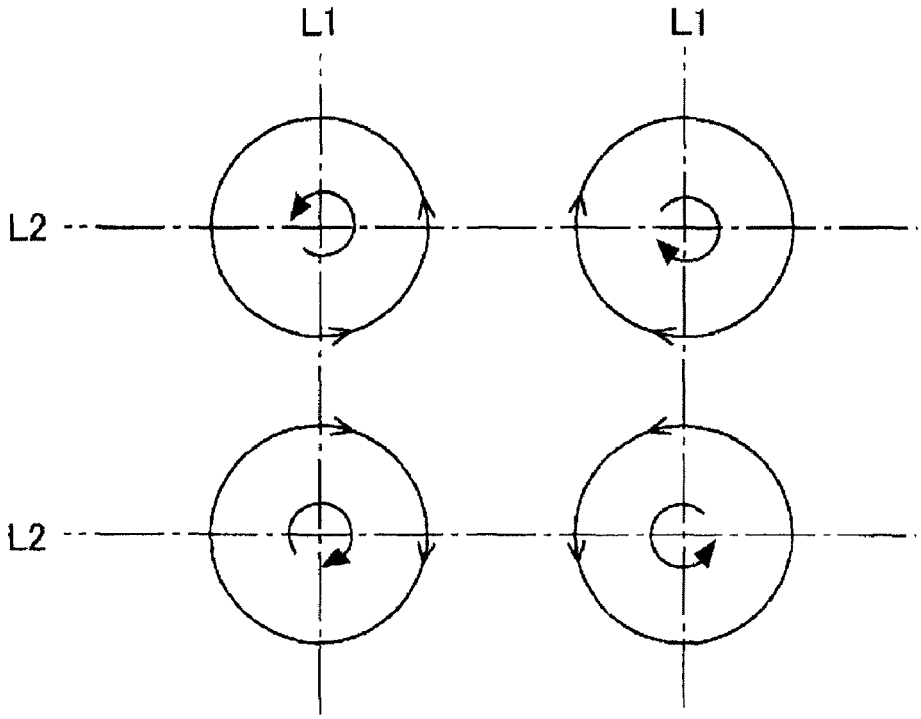
[FIG. 18]
Figure 18:
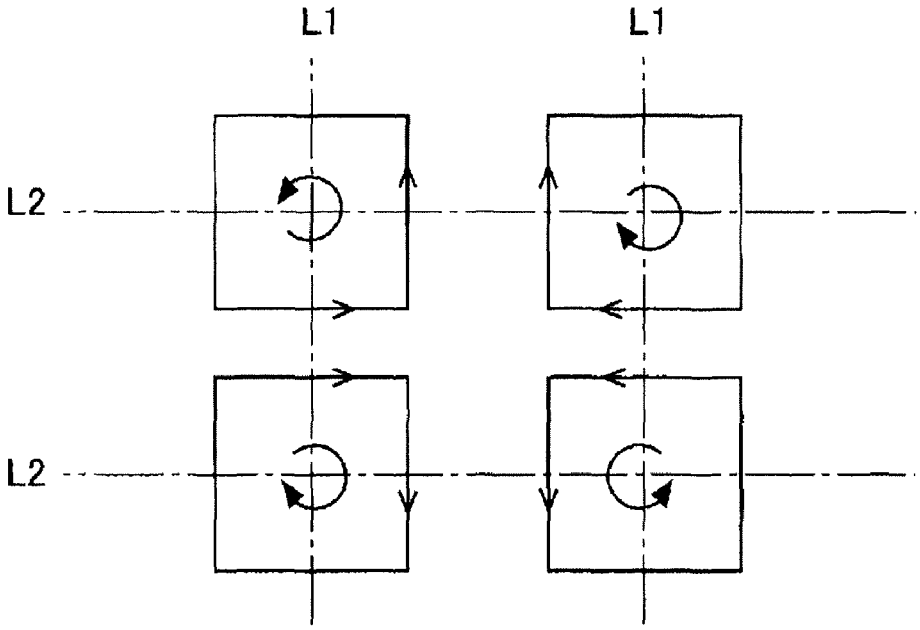
Figure 19:
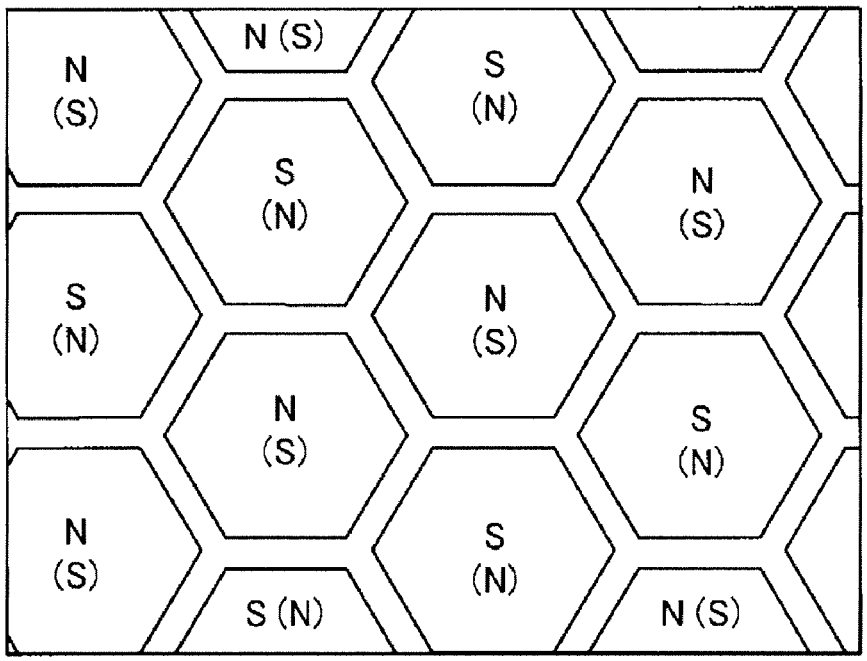
[FIG. 19]
Figure 19:
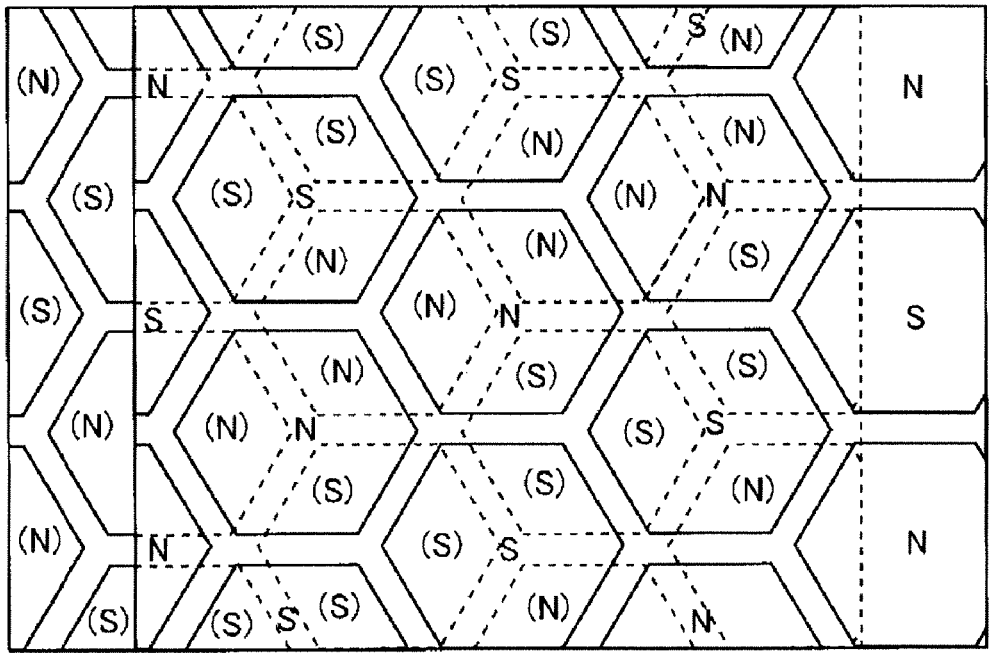
Figure 20:
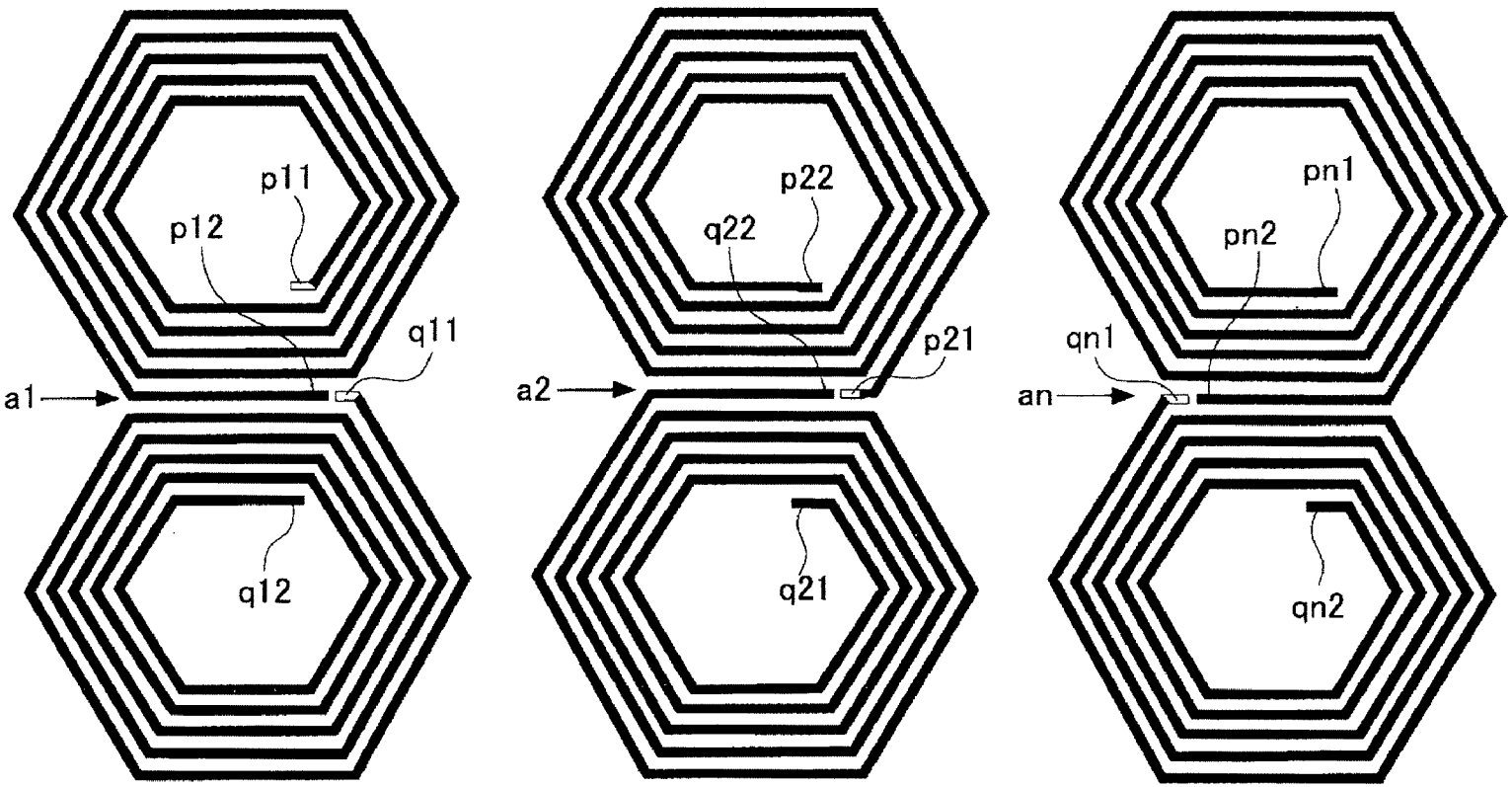
[FIG. 20]
Figure 21:
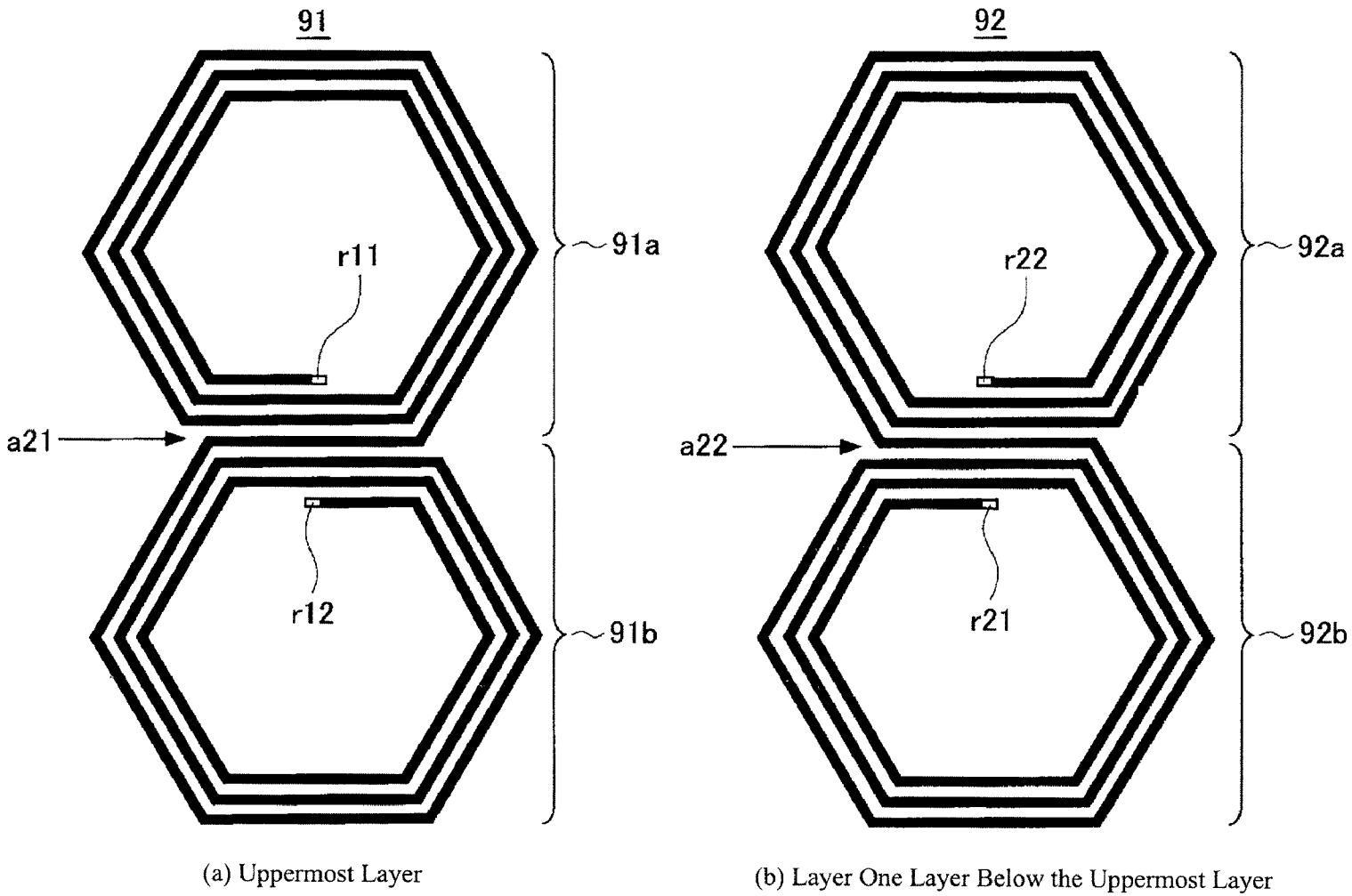
[FIG. 21]
Figure 22:
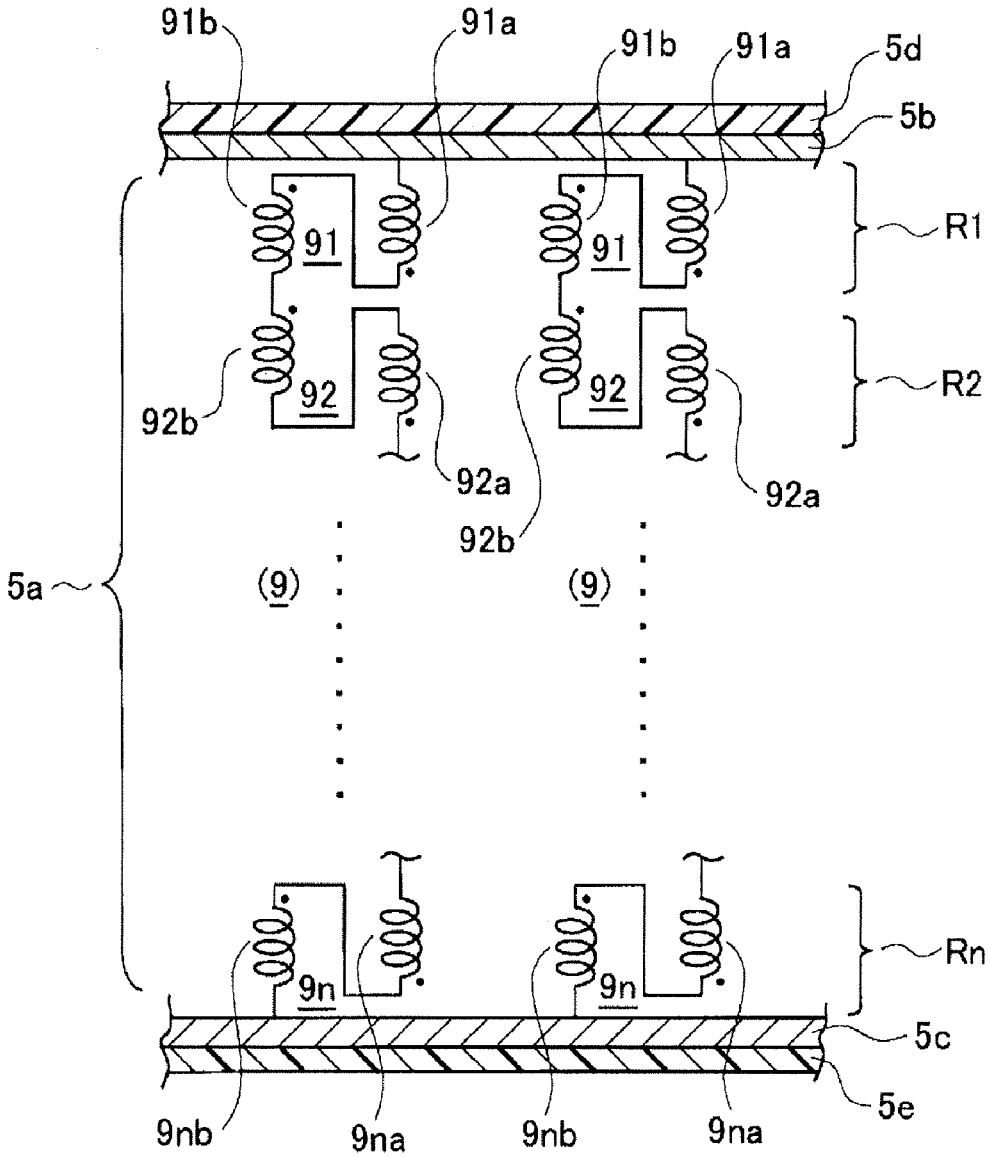
[FIG. 22]
Figure 23:
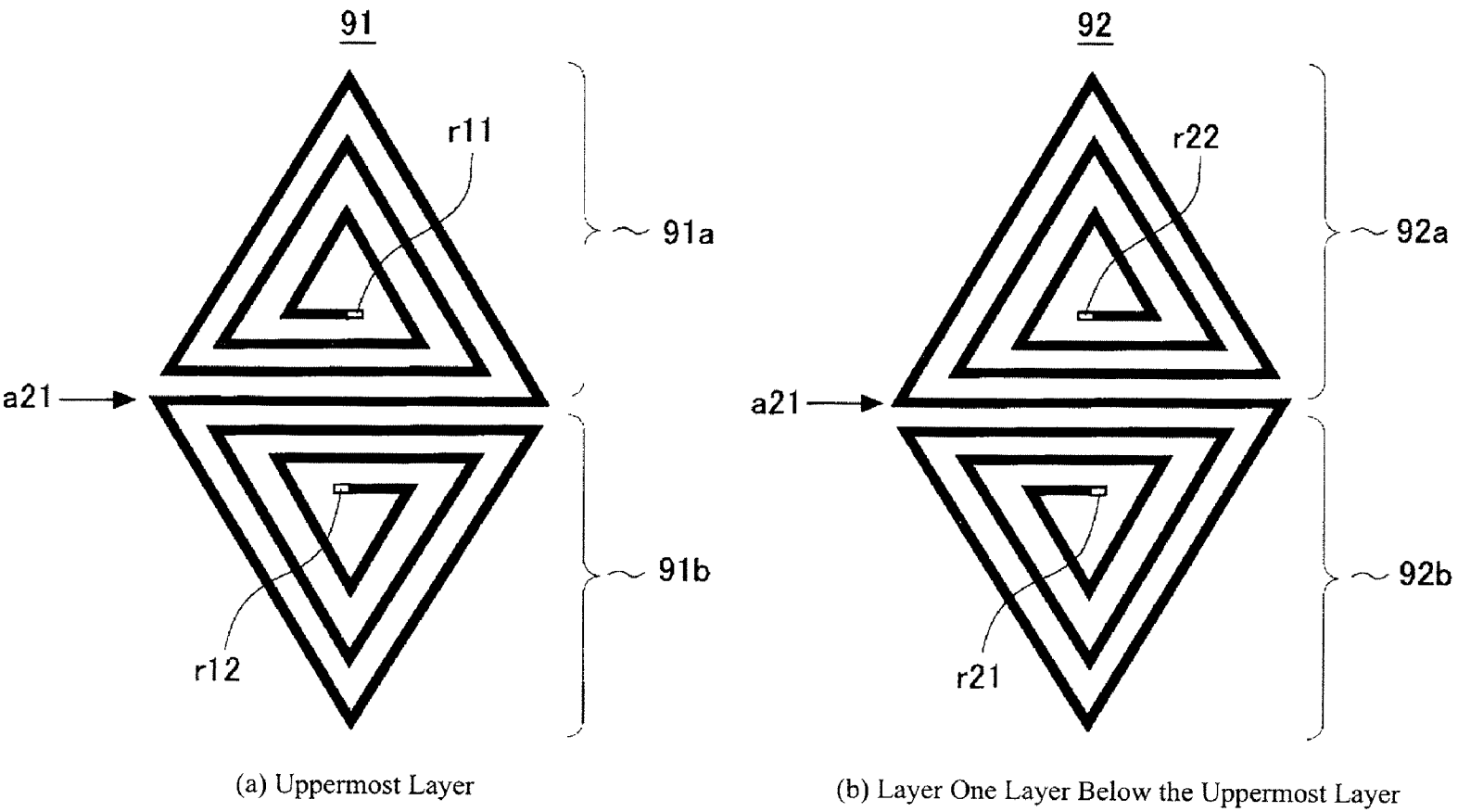
[FIG. 23]
Figure 24:
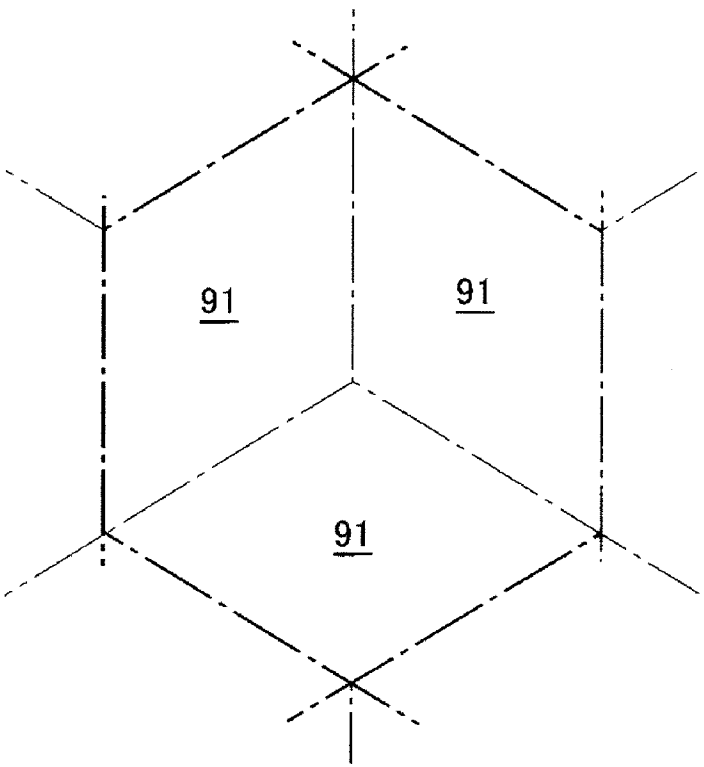
[FIG. 24]
Figure 24:
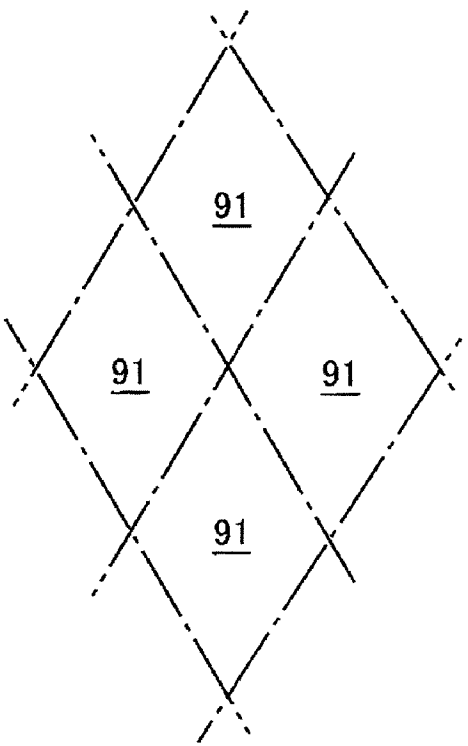

1 Planar transformer
2 Power transmitter object
3 First planar inductor
3*a* Flat coil carry layer
3*b* First interconnection layer
3*c* Second interconnection layer
4 Power receptor object
5 Second planar inductor
5*a* Flat coil carry layer
5*b* First interconnection layer
5*c* Second interconnection layer
6 Flat coil
6*a* Clockwise coil
6*b* Counterclockwise coil
7*m*, 7*m*+1, 7*m*+2, 7*m*+3 Column-wise lines
8*n*, 8*n*+1, 8*n*+2, 8*n*+3 Row-wise lines
9 Flat coil
9*a* Clockwise coil
9*b* Counterclockwise coil
10*k*, 10*k*+1, 10*k*+2, 10K+3 Column-wise lines
11*l*, 11*l*+1, 11*l*+2, 11*l*+3 Row-wise lines
12 Flexible multi-layer wiring board
12-1 12-7 Each layer board
13 First insulator film layer
14 Second insulator film layer
15 Clockwise coil
16 Counterclockwise coil
17 Through hole
18 Through hole
19-1 19-7 Each ring conductor pattern
20-1 20-7 Each ring conductor pattern
21*a* Shield partition
22 Solid conductor pattern
23 Flux-passing hole
24 Flux-passing hole
25 First ring end
26 Second ring end
27 Via (connection component)
28 Via (connection component)
29 Gap
30 Through hole
31-1 31-6 Each spiral conductor pattern
32 Innermost end
33 Outermost end
34 Solid conductor pattern
35 Via (connection component)
36 Solid conductor pattern
40 Pipe
41 Pipe core mounted on the grid base
42 Line pattern
43 Antenna pattern
T11, T12 Primary terminal
T21, T22 Secondary terminal
Φ Coil diameter
a Coil interval
b Distance between axis centers
L1, L2 Coil

What is claimed is:

1. A planar inductor, comprising:

a plurality of flat coils, a flat coil carry layer carrying said flat coils arrayed in a plane, a first interconnection layer provided on one side of the flat coil carry layer, and a second interconnection layer provided on the other side of the flat coil carry layer, wherein a start point of the each flat coil is connected through the first interconnection layer and an end point of the each flat coil is connected through the second interconnection layer, thereby achieving a parallel electrical connection of the flat coils arrayed in a plane between the first and the second interconnection layers.

2. A planar inductor according to claim 1, wherein said flat coils are arrayed so that the turning direction of the adjacent flat coils is different.

3. A planar inductor according to claim 2, wherein said first interconnection layer and said second interconnection layer are made of a solid conductor pattern which covers all the arrayed flat coils.

4. A planar inductor according to claim 3, wherein said inductor is formed on a multi-layer printed wiring board.

5. A planar inductor according to claim 3, wherein said inductor is formed on a silicon substrate.

6. A planar inductor according to claim 2, wherein said inductor is formed on a multi-layer printed wiring board.

7. A planar inductor according to claim 6, wherein each layered conductor pattern constituting said flat coil are formed into equilateral polygon conductor pattern.

8. A planar inductor according to claim 6, wherein each layered conductor pattern constituting said flat coil is formed into S-shape conductor pattern in which a clockwise spiral conductor pattern is serially connected with a counterclockwise spiral conductor pattern.

9. A planar inductor according to claim 2, wherein said inductor is formed on a silicon substrate.

10. A planar inductor according to claim 2, wherein said first interconnection layer and said second interconnection layer are both made of a solid conductor pattern which covers all the arrayed flat coils, and said first interconnection layer of the surface side has flux-passing holes corresponding to magnetic pole positions of the flat coils.

11. A planar inductor according to claim 10, wherein said inductor is formed on a multi-layer printed wiring board.

12. A planar inductor according to claim 10, wherein said inductor is formed on a silicon substrate.

13. A planar inductor according to claim 1, wherein said first interconnection layer is made of a solid conductor pattern which covers all the arrayed flat coils, and has flux-passing holes corresponding to magnetic pole positions of the flat coils, said second interconnection layer is formed into a line pattern which connects the end points of the flat coil in the planar view, wherein said line pattern contains an antenna pattern with the given tuning characteristics.

14. A planar inductor according to claim 13, wherein said inductor is formed on a multi-layer printed wiring board.

15. A planar inductor according to claim 13, wherein said inductor is formed on a silicon substrate.

16. A planar transformer, comprising:

a first planar inductor and a second planar inductor, wherein each of said planar inductors has, in the same manner, a plurality of flat coils, a flat coil carry layer which carries said flat coils arrayed in a plane, a first interconnection layer provided on one side of the flat coil carry layer, and a second interconnection layer provided on the other side of the flat coil carry layer, wherein a start point of the each flat coil is connected through the first interconnection layer and an end point of the each flat coil is connected through the second interconnection layer, and the flat coils are arrayed so that the turning direction of the adjacent flat coils is different, the first interconnection layer and the second interconnection are each made of a solid conductor pattern covering all the arrayed flat coils, the first interconnection layer positioned on the surface has an flux-passing hole corresponding to the magnetic pole position of the flat coils, and a first insulator film layer and a second insulator film layer cover the external surfaces of the first and second interconnection layer, thereby a power transmission between said planar inductors using magnetic coupling is conducted by positioning the first planar inductor and the second planar inductor facing each other.

* * * * *